US007016628B2

(12) United States Patent
Maeda et al.

(10) Patent No.: US 7,016,628 B2
(45) Date of Patent: Mar. 21, 2006

(54) IMAGE FORMING APPARATUS HAVING DEVICE FOR CHARGING A PHOTOSENSITIVE BODY

(75) Inventors: Masahiro Maeda, Nagano (JP); Isao Inaba, Nagano (JP); Masanori Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/687,971

(22) Filed: Oct. 20, 2003

(65) Prior Publication Data

US 2004/0141770 A1 Jul. 22, 2004

(30) Foreign Application Priority Data

Oct. 18, 2002 (JP) ..... P2002-303904
Oct. 18, 2002 (JP) ..... P2002-303905
Oct. 18, 2002 (JP) ..... P2002-303906
Oct. 18, 2002 (JP) ..... P2002-303907

(51) Int. Cl.
*G03G 15/00* (2006.01)
*G03G 15/02* (2006.01)

(52) U.S. Cl. ..... 399/171

(58) Field of Classification Search ..... 399/159, 399/170, 171, 172, 168, 176
See application file for complete search history.

(56) References Cited

U.S. PATENT DOCUMENTS 5,613,172 A * 3/1997 Pietrowski et al. ..... 399/50

FOREIGN PATENT DOCUMENTS

| | | | |
|---|---|---|---|
| JP | 2-3554 Y2 | | 1/1990 |
| JP | 2-10423 B2 | | 3/1990 |
| JP | 04085562 A | * | 3/1992 |
| JP | 4-53650 Y2 | | 12/1992 |
| JP | 5-14282 Y2 | | 4/1993 |
| JP | 6-58560 B2 | | 8/1994 |
| JP | 2003156864 A | * | 5/2003 |

* cited by examiner

*Primary Examiner*—Quana Grainger
(74) *Attorney, Agent, or Firm*—Sughrue Mion, PLLC

(57) ABSTRACT

An image forming apparatus having a charger of a non-contact type opposed to a photosensitive body coated with a photosensitive layer by dipping for charging a surface of the photosensitive body and an interval between the surface of the photosensitive body and the charger is narrowed on a dip upper portion side of the photosensitive body and widened on a dip lower portion side thereof. When the charger is a scorotron charger having a discharge electrode and a grid, an interval between the grid and the surface of the photosensitive body is narrowed on the dip upper portion side of the photosensitive body and widened on the dip lower portion side.

29 Claims, 21 Drawing Sheets

IMAGE FORMING APPARATUS HAVING DEVICE FOR CHARGING A PHOTOSENSITIVE BODY

The present application is based on Japanese Patent Applications Nos. 2002-303904, 2002-303905, 2002-303906 and 2002-303907, the entire contents of which are incorporated herein by reference.

BACKGROUND OF THE INVENTION

1. Field of the Invention

The present invention relates to an image forming apparatus of a printer, a facsimile, a copier or the like for forming an image by using an electrophotography technology. Particularly, the invention relates to a charging technology for charging a photosensitive body thereof.

2. Related Art

Generally, an image forming apparatus using electrophotography technology includes a photosensitive body having a photosensitive layer at an outer peripheral face thereof, a charging unit for uniformly charging the outer peripheral face of the photosensitive body, an exposing unit for forming an electrostatic latent image by selectively exposing the outer peripheral face charged uniformly by the charging unit, a developing unit for constituting a visible image (toner image) by providing a toner which is a developing agent to the electrostatic latent image formed by the exposing unit and a transcribing unit for transcribing the toner image developed by the developing unit onto a record member of sheet or the like which is a transcribing object.

There is known a charging unit for charging the outer peripheral face of the photosensitive body utilizing a corona discharger referred to as a scorotron charger. The scorotron charger includes a discharge electrode, a supporting member for supporting the discharge electrode, a back plate for carrying out stable discharge and a grid for controlling charge potential on the photosensitive body. When charging is carried out, for example, by applying a voltage of −4KV through −6KV to the discharge electrode, applying −600V (potential dependent on potential intended to charge actually) to a grid and grounding the back plate or applying a potential the same as that of the grid to the back plate, corona discharge is generated from the discharge electrode and the photosensitive body can be charged to about −600V.

When the photosensitive body is charged by the above-described scorotron charger, as a parameter strongly effecting influence on the charge potential of the photosensitive body, there is a distance between the discharge electrode or the grid and a surface of the photosensitive body.

Therefore, the corona discharger of a related art is provided with a mechanism for making the distance between the discharge electrode and the surface of the photosensitive body constant (refer to, for example, JP-B2-2-10423, page 1, left column, page 2, right column, FIGS. 2 through 5; JP-Y2-2-3554, page 2, left column, FIGS. 2, 3; and JP-Y2-5-14282 page 2, left column, FIG. 5).

Further, there is also known a scorotron charger forming an aperture pattern of a grid by a small hole in a regular hexagonal shape to constitute an isotropic aperture rate with regard to a direction of moving the photosensitive body (for example, refer to JP-Y2-4-53650, page 1, left column, FIG. 3).

Further, there is known a corona discharger in which an inner face of a back plate is pasted with an insulator sheet such that a pasting rate at two end portions becomes larger than that of a central portion thereof to thereby prevent potential rise at the two end portions of the charger (for example, refer to JP-B2-6-58560, page 1, left column, FIG. 1)

The charge potential of the photosensitive body is inversely proportional to an electrostatic capacitance of the photosensitive layer. That is, the charge potential is proportional to a film thickness of the photosensitive layer and the thicker the photosensitive layer, the more increased is the potential.

Meanwhile, the film thickness of the photosensitive layer is provided with a film thickness deviation to some degree in view of fabrication. For example, an organic photosensitive layer which is generally used as a photosensitive layer is normally coated by dipping (dipping coating method). Although the dipping coating method is more excellent in film thickness stability than a ring coating method or the like, even with the dipping coating method, it is not rare to provide a film thickness deviation of 1 through 2 $\mu$m between an upper portion and a lower portion of dipping. Particularly, in the case of a large-sized printing photosensitive body having A3 size or more, the film thickness deviation becomes significant.

When charging is carried out for such a photosensitive body, even when the distance between the discharge electrode and the surface of the photosensitive body is maintained constant or the aperture pattern of the grid is formed to constitute the isotropic aperture rate with regard to the direction of moving the photosensitive body as in the above-described related arts, the charge potential on the photosensitive body is not constant. Further, even when the insulator sheet is pasted on the inner face of the back plate such that the pasting rate at the two end portions becomes larger than that of the central portion, the charge potential on the photosensitive body does not become constant.

For example, when there is a film thickness deviation of 1 through 2 $\mu$m between the upper portion and the lower portion of dipping of the photosensitive body, a difference of about 5 through 12 V is produced in the charge potential in an axis direction of the photosensitive body. This is the difference which cannot be disregarded in consideration of a request for high image quality formation in forming a color image of recent times. Normally, in order to achieve an excellent color image in an image forming apparatus, it is desired to make an in-plane dispersion of the charge potential (dispersion in the axis line direction of the photosensitive body) equal to or lower than 20 V, however, it is difficult to achieve the dispersion owing to an influence of a tolerance or the like of a part constituting the charger and it is a significant problem that the potential difference in the axis line direction of the photosensitive body becomes about 5 through 12 V from the start under such a situation.

SUMMARY OF THE INVENTION

It is an object of the invention to resolve the above-described problem and provide an image forming apparatus capable of achieving uniform formation of a charge potential at a surface of a photosensitive body by a simple constitution.

In order to achieve the above-described object, an image forming apparatus of the first aspect of the invention is characterized in an image forming apparatus including a photosensitive body on which a photosensitive layer is provided and a charger opposed to the photosensitive body for charging a surface of the photosensitive body, wherein an interval between the surface of the photosensitive body and the charger is narrower on a first side of the photosensitive body and widened on a second side thereof.

Preferably, when the charger is a scorotron charger including a discharge electrode and a grid, an interval between the grid and the surface of the photosensitive body is narrowed on the first side of the photosensitive body and widened on the second side.

In that case, further preferably, the interval between the grid and the surface of the photosensitive body is narrowed on the first side of the photosensitive body and widened on the dip lower potion side thereof by changing heights of grid supporting portions for supporting both sides of the grid.

Further, preferably, when the charger is a charger having a discharge electrode, an interval between the discharge electrode and the surface of the photosensitive body is narrowed on the first side of the photosensitive body and widened on the second side thereof by changing heights of electrode supporting portions for supporting both sides of the discharge electrode.

Further, preferably, when the charger is a charger having a shape of a roller, the shape of the roller is constituted by a taper shape having a large diameter on the first side of the photosensitive body and a small diameter on the second side thereof.

In this case, further preferably, a surface layer of the roller is formed by dipping.

Further, preferably, the charger is provided with a pair of spacers for rectifying the interval between the surface of the photosensitive body and the charger by being brought into contact with the surface of the photosensitive body on both sides thereof.

In this case, further preferably, the pair of spacers are provided with different colors.

According to the image forming apparatus as described above, uniform formation of charge potential on the surface of the photosensitive body can be achieved by a simple constitution.

When the charger is the scorotron charger having the discharge electrode and the grid, by making the interval between the grid for controlling the charge potential on the photosensitive body and the surface of the photosensitive body narrow on the first side of the photosensitive body and wide on the second side, uniform formation of the charge potential can further accurately be achieved.

Although in setting the interval between the surface of the photosensitive body and the charger as described above, the interval can be set by arranging a total of the charger in a state of being inclined to the photosensitive body, by changing the heights of the grid supporting portions for supporting the both sides of the grid, the interval between the grid and the surface of the photosensitive body can be narrowed on the first side of the photosensitive body and widened on the second side, or when the interval between the discharge electrode and the surface of the photosensitive body is narrowed on the first side of the photosensitive body and widened on the second side by changing the heights of the electrode supporting portions for supporting the both sides of the discharge electrode, assembling performance is promoted since it is not necessary to incline the total of the charger.

Further, when the charger is the charger having the shape of the roller, by constituting the shape of the roller by the taper shape having the large diameter on the first side of the photosensitive body and the small diameter on the second side, assembling performance is promoted since it is not necessary to incline an axis line of the roller to the photosensitive body.

Also, by providing the taper by forming the surface layer of the roller by dipping, a small taper can be provided and uniform formation of the charge potential can further accurately be achieved.

Further, by providing the pair of spacers for rectifying the interval between the surface of the photosensitive body and the charger by being brought into contact with the surface of the photosensitive body on the both sides of the charger, uniform formation of the charge potential can further accurately be achieved.

In this case, by changing the colors of the pair of spacers, erroneous assembling can be prevented.

The second aspect of the invention provides an image forming apparatus including a photosensitive body on which a photosensitive layer is provided and a charger having a discharge electrode and a grid opposed to the photosensitive body for charging a surface of the photosensitive body, wherein an aperture rate of the grid is larger on a first side of the photosensitive body than on a second side thereof.

According to the image forming apparatus as described above, uniform formation of the charge potential on the surface of the photosensitive body can be achieved.

The third aspect of the invention provides an image forming apparatus including a photosensitive body on which a photosensitive layer is provided and a charger having a discharge electrode and a back plate opposed to the photosensitive body for charging a surface of the photosensitive body, wherein an aperture rate of the back plate is smaller on a first side of the photosensitive body than on a second side thereof.

Further, the invention is characterized in an image forming apparatus including a photosensitive body on which a photosensitive layer is provided and a charger having a discharge electrode and a back plate opposed to the photosensitive body for charging a surface of the photosensitive body for discharging air by making an airflow flow along the back plate, wherein the photosensitive body is arranged such that a dip upper portion thereof is disposed on an upstream side of the airflow and a dip lower portion thereof is disposed on a downstream side of the airflow, the back plate includes an aperture for passing air and an aperture rate of the back plate is smaller on a first side of the photosensitive body than on a second side thereof.

When the aperture rate of the back plate is increased, an amount of discharge by the charger is reduced.

According to the image forming apparatus as described above, where the aperture rate of the back plate is made to be small on the first side of the photosensitive body and large on the second side and therefore, uniform formation of the charge potential on the surface of the photosensitive body can be achieved.

Further according to the image forming apparatus where air is discharged by making the airflow flow along the back plate and, ozone is discharged from inside of the charger by discharging air, stable charging operation is achieved by preventing a deterioration in the discharge electrode by stagnation of ozone.

Further, the photosensitive body is arranged such that the first side of the photosensitive body is disposed on the upstream side of the airflow and the second side of the photosensitive body is disposed on the downstream side of the airflow, the back plate includes the aperture for passing air, the aperture rate of the back plate is made to be small on the first side of the photosensitive body and large on the second side and therefore, uniform formation of the discharge potential on the surface of the photosensitive body can be achieved.

Further, by providing the aperture for passing air on the second side of the photosensitive body, that is, on the downstream side of the airflow, flow of the airflow becomes smooth and ozone can further excellently be discharged from inside of the charger.

Fourth aspect of the invention provides an image forming apparatus including a photosensitive body on which a photosensitive layer is provided and a charger having a discharge electrode, a back plate and an insulator sheet applied to an inner face of the back plate opposed to the photosensitive body for charging a surface of the photosensitive body, wherein an applying rate of the insulator sheet is smaller on a first side of the photosensitive body than on a second side thereof.

Further the invention is characterized in an image forming apparatus including a photosensitive body on which a photosensitive layer is provided and a charger having a discharge electrode and a back plate opposed to the photosensitive body for charging a surface of the photosensitive body for discharging air by making an airflow flow along the back plate, wherein the back plate includes an aperture, an aperture rate thereof is made to be small on a first side of the photosensitive body and large on a second side and the aperture is closed by an insulator sheet applied to an outer face of the back plate.

Furthermore, the invention is characterized in that the photosensitive body is arranged such that the first side of the photosensitive body is disposed on an upstream side of the airflow and the second side of the photosensitive body is disposed on a downstream side of the airflow.

When the insulator sheet is applied to the inner face of the back plate, an amount of discharge at the applied portion is reduced.

According to the image forming apparatus as described above, where the applying rate of the insulator sheet is smaller on the first side of the photosensitive body than on the second side and therefore, uniform formation of the charge potential on the surface of the photosensitive body can be achieved.

According to the image forming apparatus where air is discharged by making the airflow flow along the back plate and ozone is discharged from inside of the charger by discharging air.

Therefore, stable charging operation is achieved by preventing the deterioration in the discharge electrode by stagnation of ozone.

Further, the back plate is provided with the aperture and the aperture rate is made to be small on the first side of the photosensitive body and large on the second side and therefore, uniform formation of the charge potential on the surface of the photosensitive body can be achieved. That is, when the aperture rate of the back plate is increased, the amount of discharge by the charger is reduced and according to the invention, the aperture rate of the back plate is made to be small on the first side of the photosensitive body and large on the second side and therefore, uniform formation of the charge potential on the surface of the photosensitive body can be achieved.

Further, the aperture is closed by the insulator sheet applied to the outer face of the back plate and therefore, disturbance of the airflow by presence of the aperture can be prevented and unevenness of charge can also be prevented.

Furthermore, according to the image forming apparatus of the invention where, air is discharged by making the airflow flow along the back plate and therefore, ozone is discharged from inside of the charger by discharging air.

Therefore, stable charging operation is achieved by preventing the deterioration in the discharge electrode by stagnation of ozone.

Further, the photosensitive body is arranged such that the dip upper portion is disposed on the upstream side of the airflow and the dip lower portion is disposed on the downstream side of the airflow, the back plate is provided with the aperture, and the aperture rate is made to be small on the first side of the photosensitive body and large on the second side and therefore, uniform formation of the charge potential on the surface of the photosensitive body can be achieved.

Further, the aperture is closed by the insulator sheet applied to the other face of the back plate while leaving a portion thereof on the downstream side of the airflow and therefore, by constituting the aperture for passing air by the portion of the aperture which is not closed and providing the aperture for passing air on the second side of the photosensitive body, that is, on the downstream side of the airflow, flow of the airflow is made to be smooth and ozone can further excellently be discharged from inside of the charger.

BRIEF DESCRIPTION OF THE DRAWINGS

FIG. 4A is a graph showing a change in a film thickness of a photosensitive body and FIG. 4B is an outline view of an image carrier unit.

FIG. 5A is a graph showing a change in a film thickness of a photosensitive layer and FIG. 5B is an outline view of an image carrier unit.

FIG. 6A is a graph showing a change in a film thickness of a photosensitive layer and FIG. 6B is an outline view of an image carrier unit.

FIG. 7A is a front view, FIG. 7B is a side view and FIG. 7C is a plane view when the front view is constituted by FIG. 7B.

FIG. 8A is a graph showing a change in a film thickness of a photosensitive layer in an axis line direction of a photosensitive body, FIG. 8B is an outline view of an image carrier unit and FIG. 8C is a partially omitted enlarged view of FIG. 8B.

FIG. 9A is a graph showing a change in a film thickness of a photosensitive layer in an axis line direction of a photosensitive body, FIG. 9B is an outline view of an image carrier unit and FIG. 9C is a partially omitted enlarged view of FIG. 9B.

FIG. 10A is a graph showing a change in a film thickness of a photosensitive layer and FIG. 10B is an outline view of an image carrier unit.

FIG. 11A is a graph showing a change in a film thickness of a photosensitive layer and FIG. 11B is an outline view of an image carrier unit.

FIG. 12A is a graph showing a change in a film thickness of a photosensitive layer, FIG. 12B is an outline view of an image carrier unit, FIG. 12C is a plane view of a grid, FIG. 12D is an enlarged view of a portion d in FIG. 12C and FIG. 12E is an enlarged view of a portion e in FIG. 12C.

FIG. 14A is a graph showing a change in a film thickness of a photosensitive layer in an axis line direction of a photosensitive body, FIG. 14B is an outline view of an image carrier unit, FIG. 14C is a front view of a charger, FIG. 14D is a bottom view of the charger and FIG. 14E is a plane view of the charger.

FIG. 15A is a graph showing a change in a film thickness of a photosensitive layer, FIG. 15B is an outline left side view of an image carrier unit, FIG. 15C is a front view of a charger when the front view is constituted by FIG. 15B, FIG. 15D is similarly a bottom view of the charger and FIG. 15E is similarly a plane view of the charger.

FIG. 17A is a graph showing a change in a film thickness of a photosensitive layer in an axial line direction of a photosensitive body, FIG. 17B is an outline view of an image carrier unit, FIG. 17C is a front view of a charger, FIG. 17D is a sectional view taken along a line d—d of FIG. 17C and FIG. 17E is a sectional view taken along a line e—e of FIG. 17C.

FIG. 18A is a graph showing a change in a film thickness of a photosensitive layer, FIG. 18B is an outline left side view of an image carrier unit, FIG. 18C is a front view of a charger when the front view is constituted by FIG. 18B

FIG. 20A is a graph showing a change in a film thickness of a photosensitive layer, FIG. 20B is an outline left side view of an image carrier unit, FIG. 20C is a front view of a charger when the front view is constituted by FIG. 20B and FIG. 20D is similarly a front view of an insulator sheet.

BRIEF DESCRIPTION OF THE PREFERRED EMBODIMENTS

Embodiments of the invention will be explained in reference to the drawings as follows.

Figure 1:
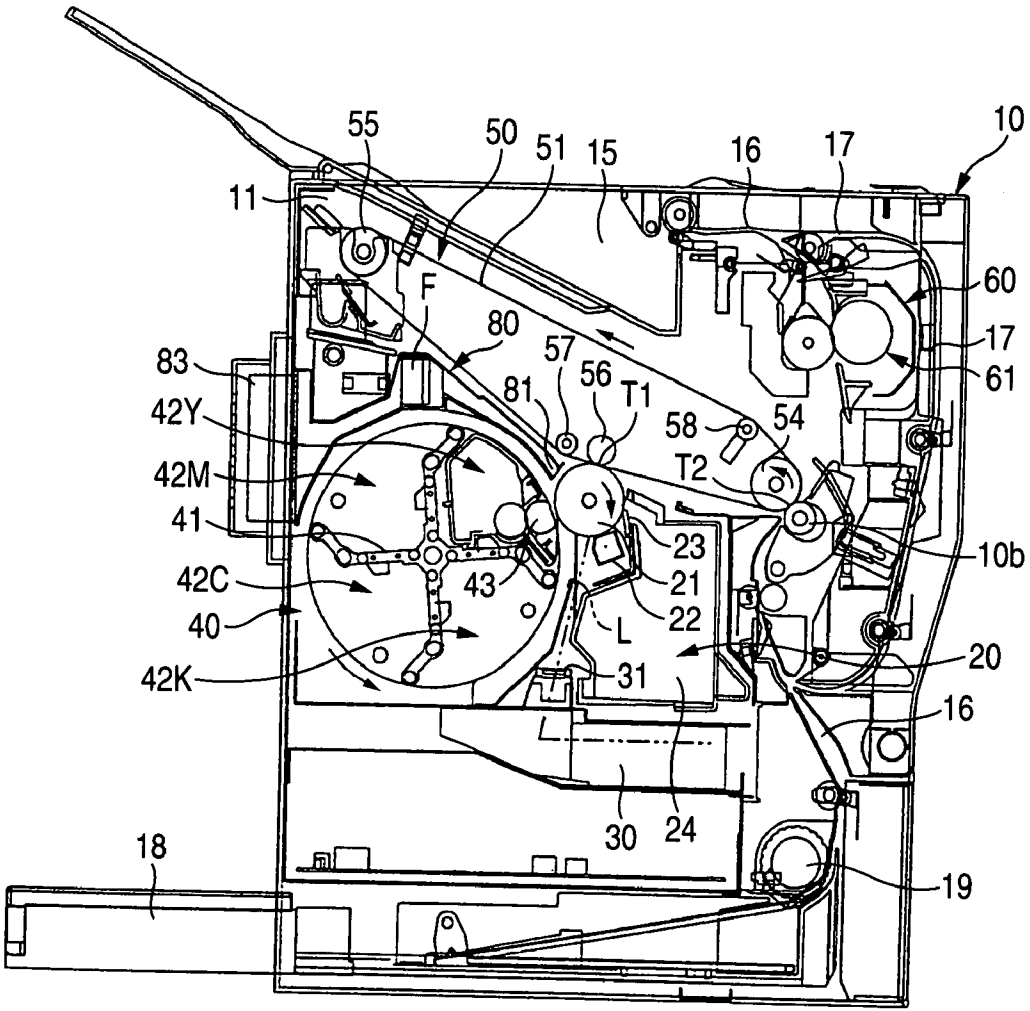
FIG. 1 is an outline front view showing an inner structure of a first embodiment.

FIG. 1 is an outline front view showing an inner structure of an image forming apparatus according to the invention.

The image forming apparatus is a color image forming apparatus capable of forming full color images on both faces of sheets (record member) of A3 size and is provided with a case 10, an image carrier unit 20 contained at inside of the case 10, an exposing unit 30 as exposing means, a developer (developing apparatus) 40 as exposing means, a middle transcriber unit 50 and a fixing unit (fixer) 60 as fixing means.

The case 10 is provided with a frame (not illustrated) of an apparatus main body and the respective units and the like are attached to the frame.

The image carrier unit 20 includes a photosensitive body (image carrier) 21 having a photosensitive layer at an outer peripheral face thereof and charging unit (scorotron charger) 22 for uniformly charging the outer peripheral face of the photosensitive body 21 and is constituted such that an electrostatic latent image is formed by selectively exposing the outer peripheral face of the photosensitive body 21 charged uniformly by the charging unit 22 by laser beam L from the exposing unit 30, a visible image (toner image) is constituted by providing toners as developing agent to the electrostatic latent image by the developer 40, the toner image is primarily transcribed to a middle transcribing belt 51 of the middle transcriber unit 50 by a primary transcribing portion T1, further, secondarily transcribed to sheet which is an object to be transcribed by a secondary transcribing portion T2.

The image carrier unit 20 is provided with a cleaning unit (cleaning blade) 23 for removing the toner remaining on a surface of the photosensitive body 21 after primary transcription and a waste toner containing portion 24 for containing the waste toner removed by the cleaning unit.

Inside of the case 10 is provided with a carrier path 16 for carrying a sheet formed with an image on one face thereof by the secondary transcribing portion T2 to a sheet discharging portion (sheet discharging tray portion) 15 and a return path 17 for switching back sheet carried to the sheet discharging portion 15 by the carrier path 16 to return to the secondary transcribing portion T2 to form an image also on other face thereof.

A lower portion of the case 10 is provided with a sheet feeding tray 18 for laminating to hold a plurality of sheets and a sheet feed roller 19 for feeding the sheets to the secondary transcribing portion T2 sheet by sheet.

The developer 40 is a rotary developer and is mounted with a plurality of developer cartridges respectively containing toners attachably and detachably to and from a rotary member main body 41. According to the embodiment, a developer cartridge 42Y for yellow, a developer cartridge 42M for magenta, a developer cartridge 42C for cyan and a developer cartridge 42K for black are provided (in the drawing, only the developer cartridge 42Y for yellow is directly drawn) and a surface of the photosensitive body 21 can selectively be developed by selectively bringing a developing roller 43 into contact with the photosensitive body 21 by rotating the rotating member main body 41 by a pitch of 90 degrees in an arrow mark direction.

The exposing unit 30 irradiates the laser beam L to the photosensitive body 21 from an exposing window 31 constituted by plate glass or the like.

The middle transcriber unit 50 is provided with a unit frame, not illustrated, a drive roller 54 rotatably supported by the frame, a driven roller 55, a primary transcribing roller 56, a guide roller 57 for stabilizing a state of the belt 51 at the primary transcribing portion T1, and a tension roller 58 and the middle transcribing belt 51 made to wrap around the rollers to stretch and the belt 51 is driven to circulate in an illustrated arrow mark direction. The primary transcribing portion T1 is formed between the photosensitive body 21 and the primary transcribing roller 56 and the secondary transcribing portion T2 is formed at a portion for bringing the drive roller 54 and a secondary transcribing roller 10*b* provided on the main body side into press contact with each other.

The second transcribing roller 10*b* can be contacted to and separated from the driver roller 54 (and therefore, the middle transcribing belt 51) and the secondary transcribing portion T2 is formed when the both members are brought into contact with each other.

Therefore, when a color image is formed, the color image is formed by overlapping a plurality of colors of toner images on the middle transcribing belt 51 in a state in which the secondary transcribing roller 10*b* is separated from the middle transcribing belt 51, thereafter, the secondary transcribing roller 10*b* is brought into contact with the middle transcribing belt 51 and the color image (toner image) is transcribed onto sheet by supplying sheet to the contact portion (secondary transcribing portion T2).

Sheet transcribed with the toner image passes through a pair of heating rollers 61 of the fixing unit 60 to thereby melt to fix the toner image and is discharged to the discharge sheet tray portion 15.

The fixer 60 is constituted by an oilless fixer in which oil is not coated on the heating roller 61.

Figure 2:
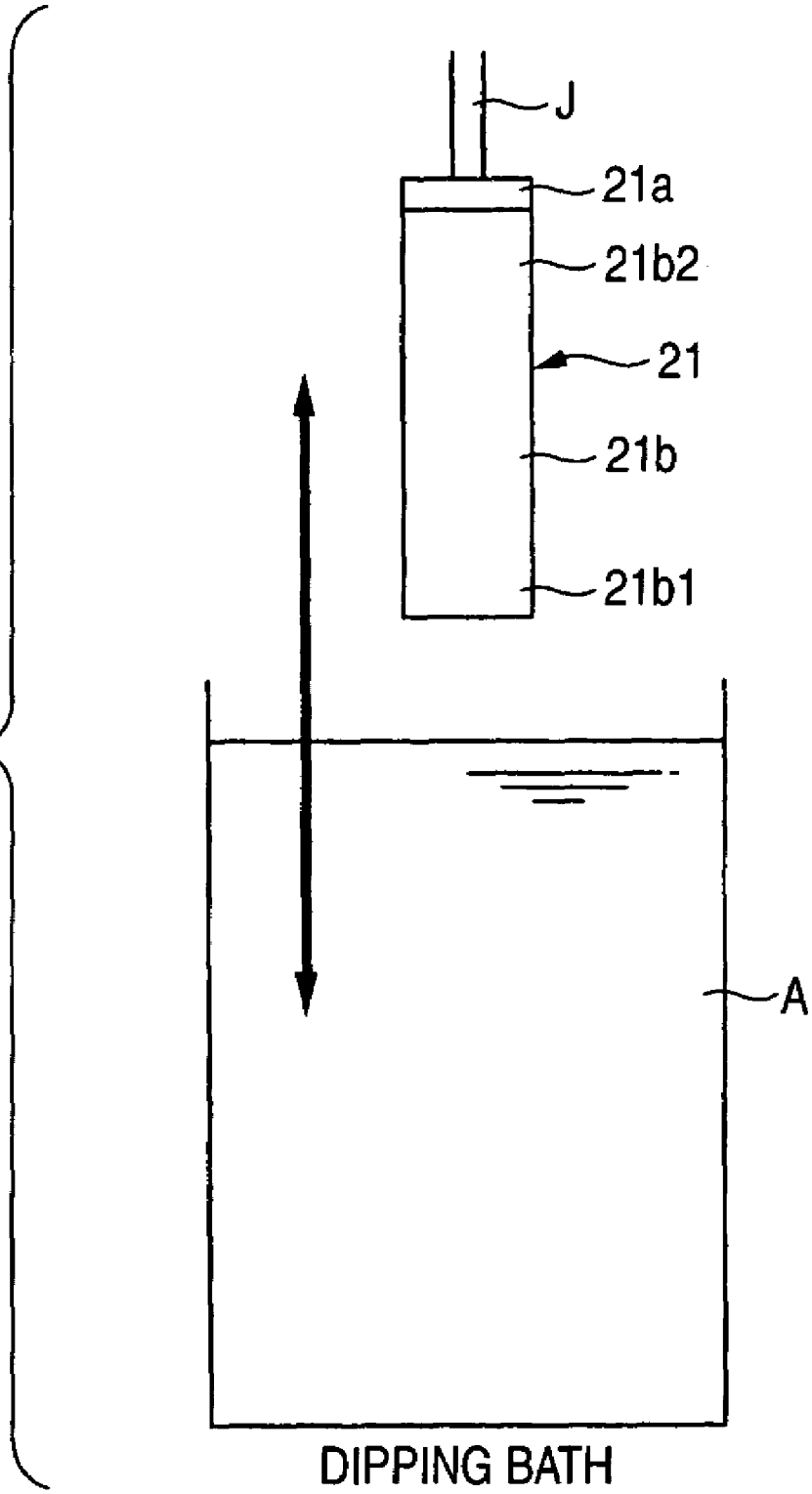
FIG. 2 is an explanatory view of dipping.

For example, according to the above-described color image forming apparatus, a photosensitive layer of the photosensitive body 21 is formed by dipping (dipping coating method) as shown by, for example, FIG. 2.

That is, a photosensitive layer 21*b* is formed on a surface of a base member 21*a* by grubbing the base member 21*a* by a jig J and dipping in a coating solution A and pulling up the base member 21*a* as shown by an arrow mark.

The photosensitive layer 21*b* formed in this way is provided with a film thickness deviation of 1 through 2 μm between a dip upper portion 21*b*2 and a dip lower portion 21*b*1. A film thickness of the dip upper portion 21*b*2 is thinner than a film thickness of the dip lower portion 21*b*1 by 1 through 2 μm.

A charge potential at a surface of the photosensitive body is inversely proportional to an electrostatic capacitance of the photosensitive layer. That is, the charge potential is proportional to the film thickness of the photosensitive layer and the thicker the film thickness, the more increased is the potential.

Figure 3:
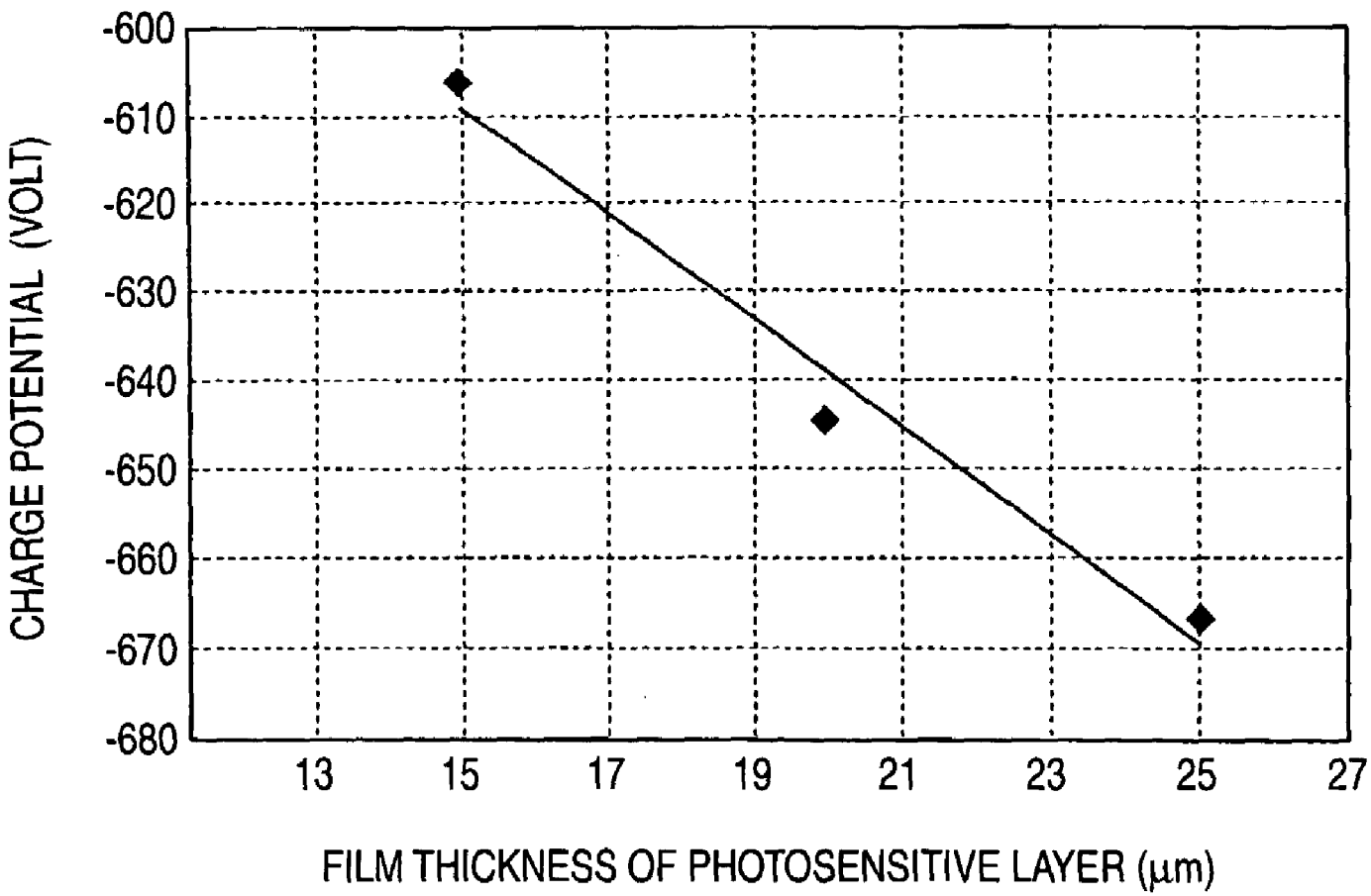
FIG. 3 is a view of a graph showing an example of a relationship between a film thickness of a photosensitive body and a charge potential.

FIG. 3 is a graph showing an example of a relationship between the film thickness of the photosensitive body and the charge potential.

The graph is formed as follows.

(1) There are prepared 3 pieces of photosensitive drums coated with photosensitive layers by changing film thicknesses by about 5 μm.

(2) The film thicknesses of 3 pieces of the photosensitive drums are measured by a film thickness meter of an eddy current type at the positions for measuring large potentials.

(3) Charge potential per 1 μm is calculated from the respective measured values to form the graph shown in FIG. 3.

It is known from the above-described result that there is brought about a difference between charge potentials of about 5 through 6 V per 1 μm of the film thickness of the photosensitive body. For example, when the film thicknesses of the photosensitive layer differ from each other by 2 μm between the dip upper portion and the dip lower portion of the photosensitive drum, there is a difference of about 10 through 12 V between the charge potentials.

Therefore, in the case of charging such a photosensitive body, even when the distance between the discharge electrode and the surface of the photosensitive body is maintained constant or the aperture pattern of the grid is formed to constitute an isotropic aperture rate in the direction of moving the photosensitive body as in the above-described related arts, the charge potential on the photosensitive body is not constant. Further, even when the insulator sheet is pasted on the inner face of the back plate such that the pasting rate at the both end portions is larger than that of the central portion, the charge potential on the photosensitive body is not constant.

Hence, in First Embodiment through Seventh Embodiment according to the invention which are described below, an interval between the surface of the photosensitive body and the charger is narrowed on the dip upper portion side (first side of the invention) of the photosensitive body and widened on the dip lower portion side (second side of the invention) of the photosensitive body.

<First Embodiment>

Figures 4A, 4B:
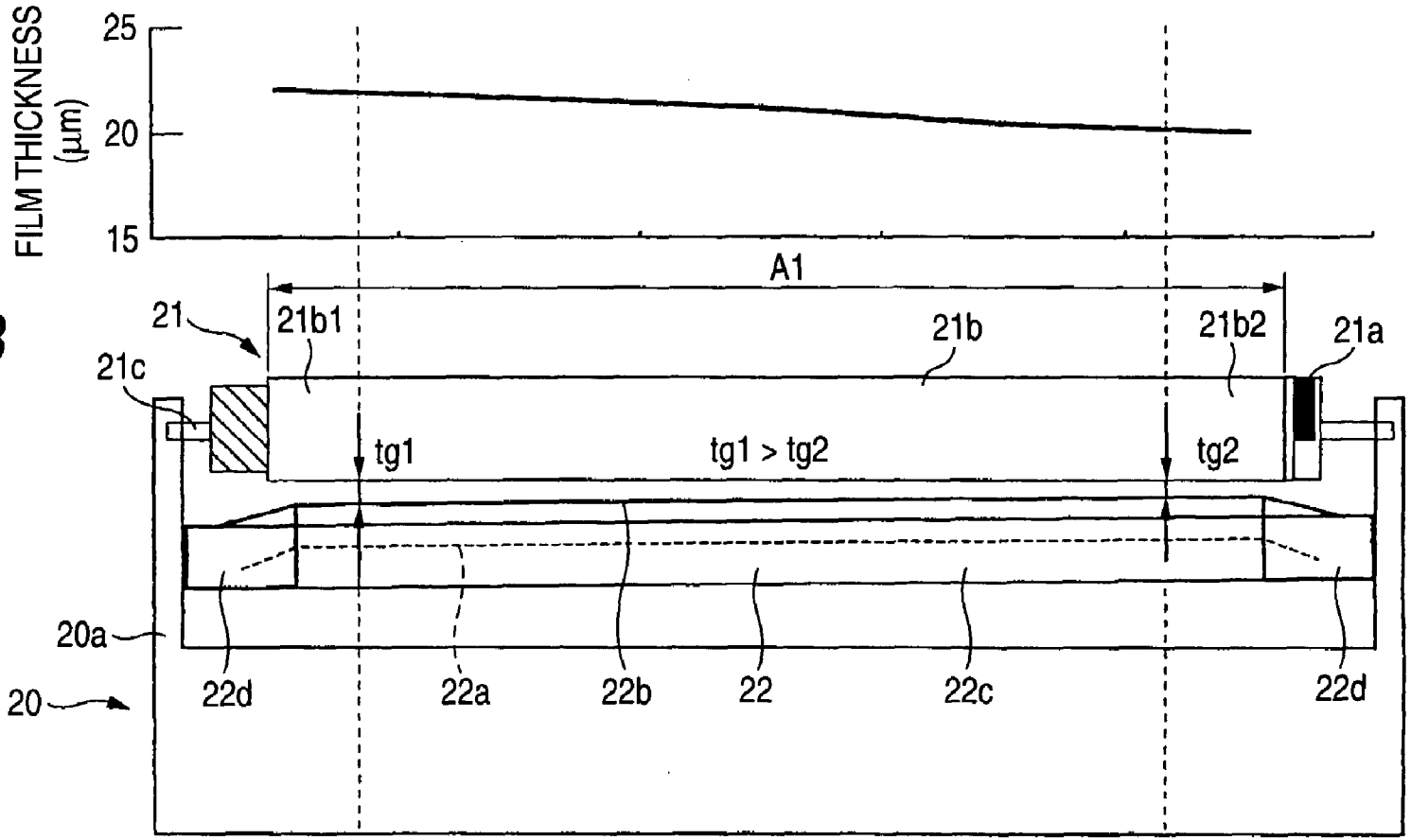
FIG. 4A and FIG. 4B are views showing an essential portion of the first embodiment.

According to a first embodiment explained here, as shown by FIGS. 4A and 4B, the charger 22 is a scorotron charger having a discharge electrode 22*a* and a grid 22*b* and by slightly inclining a total of the charger 22 to an axis line of the photosensitive body 21, an interval between the grid 22*b* and a surface of the photosensitive body 21 is narrowed on a side of the dip upper portion 21*b*2 of the photosensitive body 21 (the interval is designated by notation tg2) and widened on a side of the dip lower portion 21*b*1 (the interval is designated by notation tg1).

Further, FIG. 4A is a graph showing a change in the film thickness of the photosensitive layer 21*b* in the axis line direction of the photosensitive body 21 and FIG. 4B is an outline view of the image carrier unit 20.

Notation 20*a* designates a case of the image carrier unit 20, the photosensitive body 21 is rotatably supported by the unit case 20*a* at a shaft 21*c* thereof and is driven to rotate by a drive mechanism, not illustrated. Notation A1 designates a photosensitive layer coating region.

The charger 22 is attached to the unit case 20*a*. Notation 22*c* designates a black plate, notation 22*d* designates a pair of left and right supporting members for supporting the discharge electrode 22*a* in a wire-like shape and the grid 22*b*, which are attached to both end portions of the back plate 22*c*.

According to the above-described image forming apparatus, the following operation and effect are achieved.

(a) The image forming apparatus is provided with the photosensitive body 21 coated with the photosensitive layer 21*b* by dipping and the charger 22 of a non-contact type arranged to be opposed to the photosensitive body 21 for charging a surface of the photosensitive body 21 and the interval between the surface of the photosensitive body 21 and the charger 22 is narrowed on the side of the dip upper portion 21*b*2 of the photosensitive body 21 and widened on the side of the dip lower portion 21*b*1 thereof and therefore, according to the image forming apparatus, uniform formation of the charge potential at the surface of the photosensitive body can be achieved by a simple constitution.

That is, by constructing the above-described constitution, uniform formation of the charge potential can be achieved by canceling the charge potential difference on the photosensitive body which is to be brought about when the distance between the discharge electrode and the surface of the photosensitive body is maintained constant or the aperture pattern of the grid is formed to constitute the isotropic aperture rate in the direction of moving the photosensitive body, assumedly, as in the above-described related arts.

For example, by constituting tg1−tg2=0.3 mm, a charge potential difference of 12V by a film thickness deviation of 2 μm can be canceled.

(b) Further, according to the first embodiment, the interval between the grid 22*b* and the surface of the photosensitive body 21 is narrowed on the side of the dip upper portion 21*b*2 of the photosensitive body 21 and widened on the side of the dip lower portion 21*b*1 for controlling the charge potential of the photosensitive body 21 and therefore, the uniform formation of the charge potential can further accurately be achieved.

<Second Embodiment>

Figures 5A, 5B:
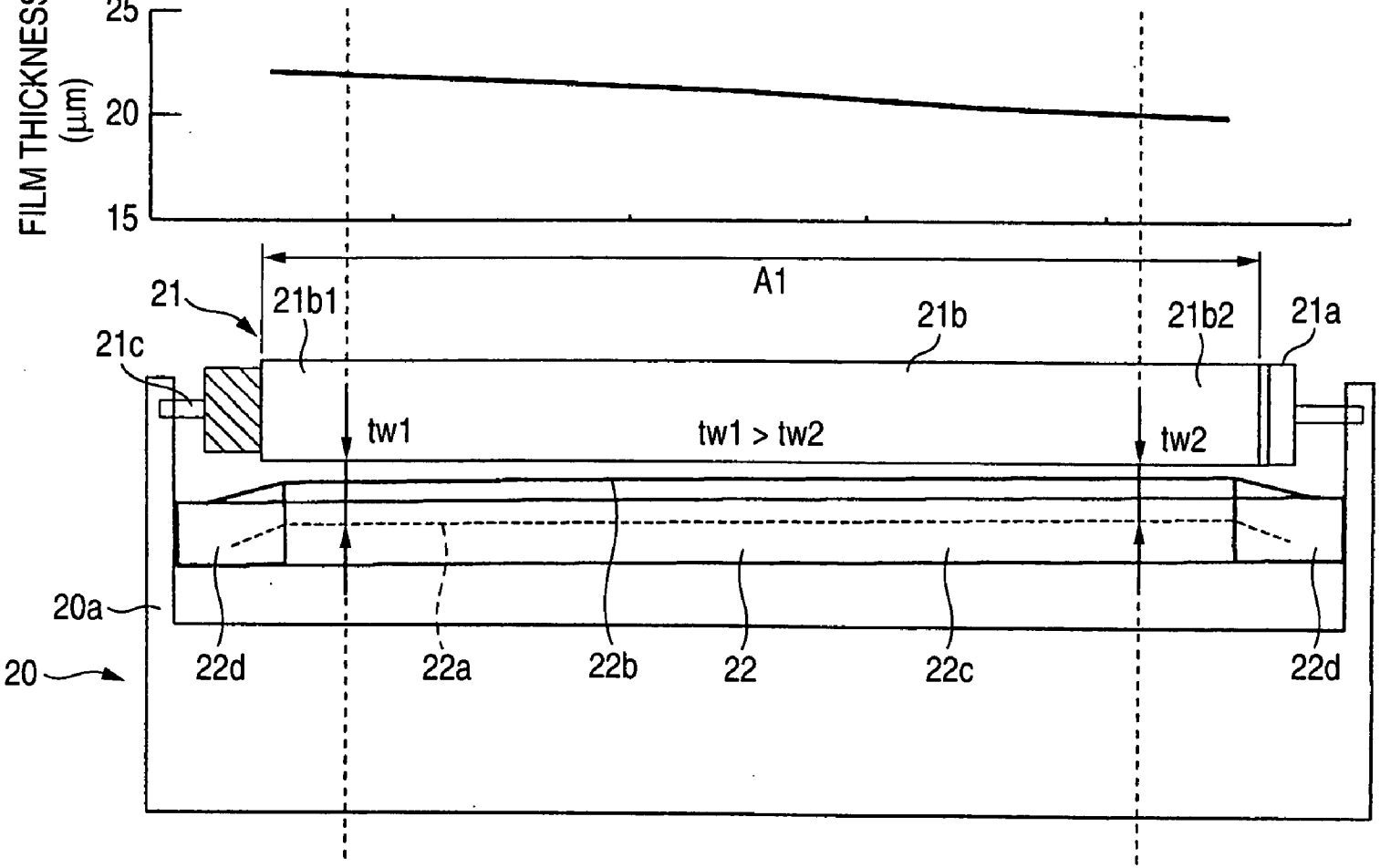
FIG. 5A and FIG. 5B are views showing an essential portion of a second embodiment.

FIGS. 5A and 5B are views showing an essential portion of a second embodiment of the image forming apparatus according to the invention, FIG. 5A is a graph showing a change in the film thickness of the photosensitive layer 21*b* in the axis line direction of the photosensitive body 21 and FIG. 5B is an outline view of the image carrier unit 20. In the drawings, portions the same as those or portions in correspondence with those of the above-described first embodiment are attached with the same notations.

A point of the embodiment which differs from that of the above-described first embodiment resides in that by slightly inclining the total of the charger 22 to the axis line of the photosensitive body 21, an interval between the discharge electrode 22*a* and the surface of the photosensitive body 21 is narrowed on the side of the dip upper portion 21*b*2 of the photosensitive body 21 (the interval is designated by notation tw2) and widened on the side of the dip lower portion 21*b*1 (the interval is designated by notation tw1) and the other points remain unchanged.

Further, although according to the embodiment, by inclining the total of the charger 22 to the axis line of the photosensitive body 21, similar to the first embodiment, also the grid 22*b* is inclined to the axis line of the photosensitive body 21, according to the embodiment, the grid 22*b* is not necessarily indispensable. That is, the embodiment is effective even when the charger 22 is not provided with the grid 22*b*.

Operation and effect of (a) by the above-described first embodiment is achieved even by the embodiment.

<Third Embodiment>

Figure 6A:
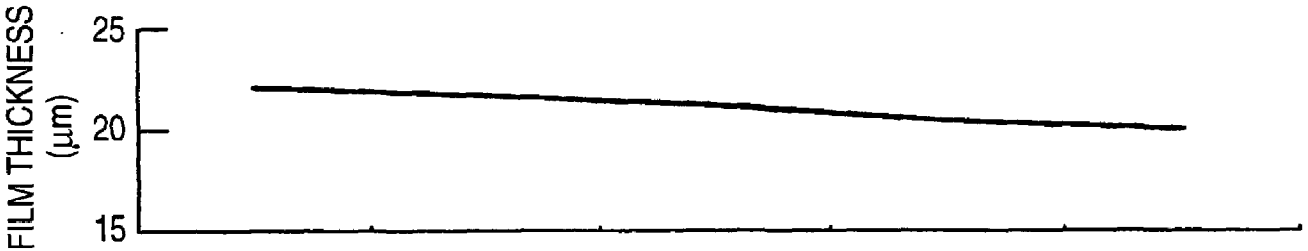
FIG. 6A and FIG. 6B are views showing an essential portion of a third embodiment.
Figure 6B:
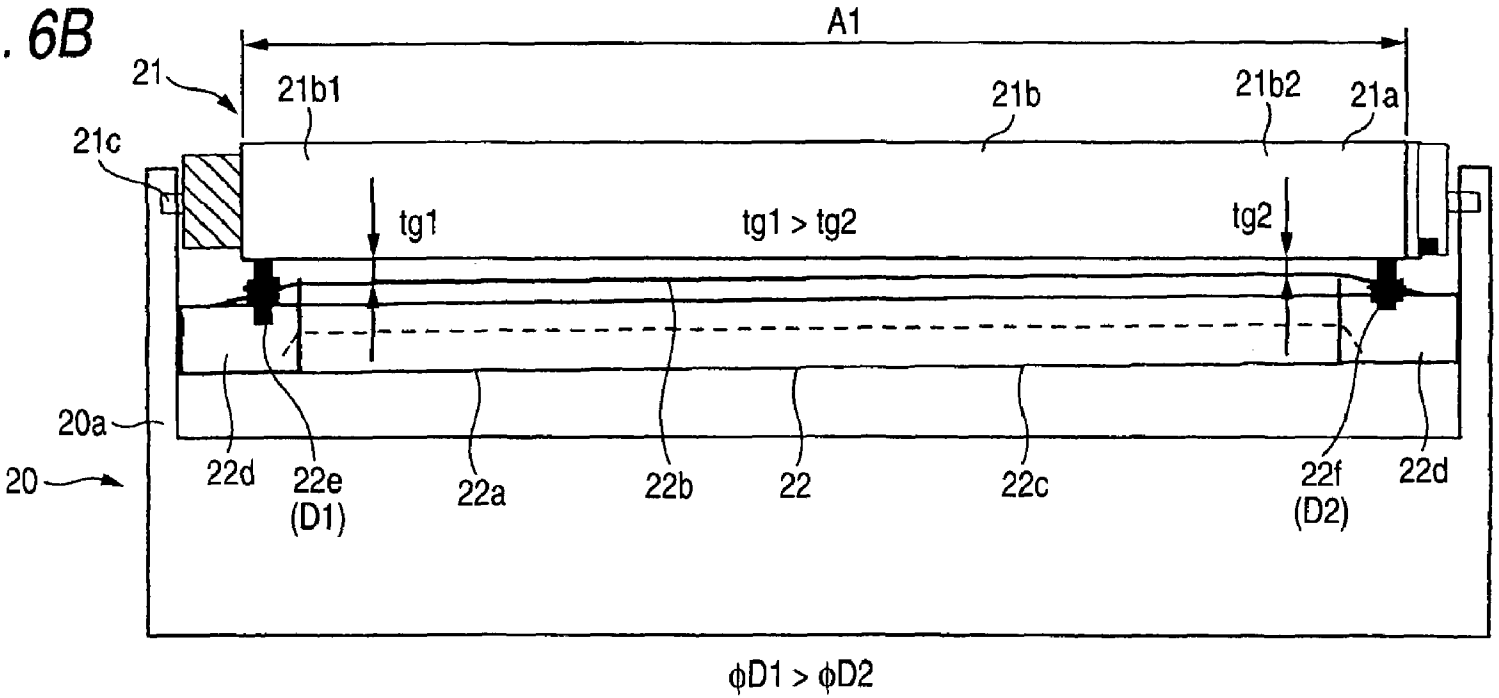

FIGS. 6A and 6B are views showing an essential portion of a third embodiment of the image forming apparatus according to the invention, FIG. 6A is a graph showing a change in the film thickness of the photosensitive layer 21*b* in the axial line direction of the photosensitive body 21 and FIG. 6B is an outline view of the image carrier unit 20. In the drawings, portions the same as or in correspondence with those of the above-described first embodiment are attached with the same notations.

A point of the embodiment which differs from the above-described first embodiment reside in that the charger 22 is provided with a pair of spacers 22*e* and 22*f* which are brought into contact with the surface of the photosensitive body 21 on both sides thereof to rectify the interval between the surface of the photosensitive body 21 and the charger 22 and the other points remain unchanged.

The pair of spacers 22*e* and 22*f* are provided with different colors.

Figure 7C:
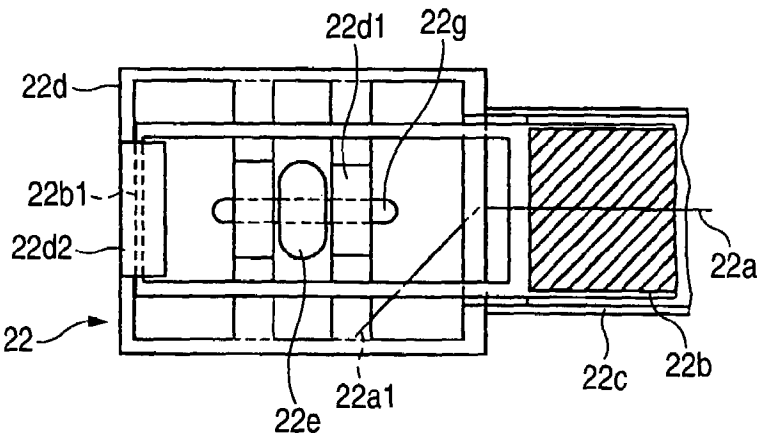
FIGS. 7A through 7C are views showing a structure of attaching a spacer.
Figure 7B:
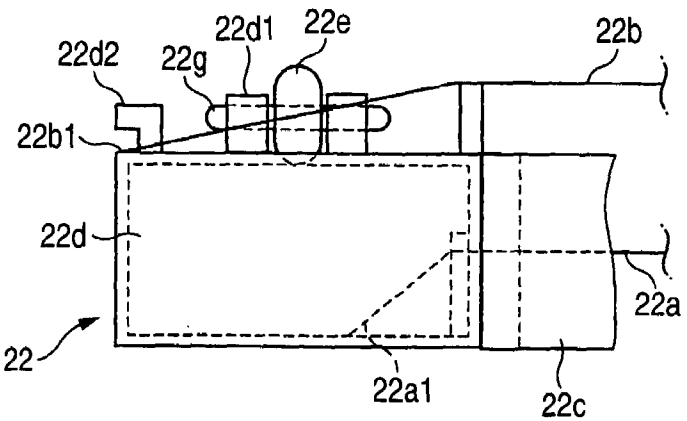
Figure 7A:
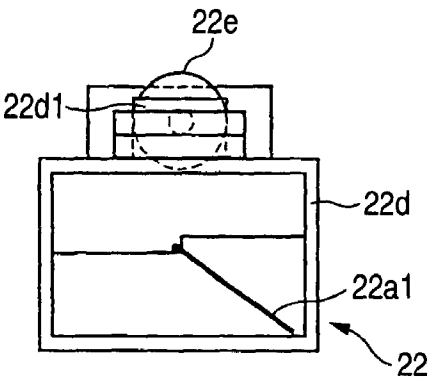

FIGS. 7A through 7C are views showing a structure of attaching the spacer 22*e*, FIG. 7A is a front view, FIG. 7B is a side view and FIG. 7C is a plane view when the front view is constituted by FIG. 7B. Further, a structure of attaching the spacer 22*f* is similar to the structure of attaching the spacer 22*e*.

The spacer 22*e* is constituted by a roller and rotatably supported on a bearing portion 22*d*1 of the supporting member 22*d* by a shaft 22*g* thereof.

Further, the grid 22*b* is stretched between the supporting members 22*d*, 22*d* by hanging both end portions 22*b*1 (only one thereof is illustrated in FIGS. 7A through 7C) at hook portions 22*d*2 of the supporting members 22*d*. The discharge electrode 22*a* is stretched between the supporting members 22*d*, 22*d* by hanging both end portions 22*a*1 (only one thereof is illustrated in FIGS. 7A through 7C) at hang portions, not illustrated, of the supporting members 22*d*.

According to the embodiment, as shown by FIGS. 6A and 6B, by making a diameter D2 of the spacer 22*f* brought into contact with the side of the dip upper portion 21*b*2 slightly smaller than a diameter D1 of the spacer 22*e* brought in contact with the side of the dip lower portion 21*b*1 of the photosensitive body 21, the total of the charger 22 is slightly inclined to the axis line of the photosensitive body 21 and the interval between the grid 22*b* and the photosensitive body 21 is narrowed on the side of the dip upper portion 21*b*2 of the photosensitive body 21 (the interval is designated by notation tg2) and widened on the side of the dip lower portion 21*b*1 (the interval is designated by notation tg1). Further, also the interval between the discharge electrode 22*a* and the surface of the photosensitive body 21 is narrowed on the side of the dip upper portion 21*b*2 of the photosensitive body 21 and widened on the side of the dip lower portion 21*b*1.

Operation and effect of (a) and (b) according to the above-described first embodiment are achieved also by the embodiment.

Further, the uniform formation of the charge potential can further accurately be achieved by providing the pair of spacers 22*e* and 22*f* for rectifying the interval between the surface of the photosensitive body 21 and the charger 22 by being brought into contact with the surface of the photosensitive body 21 on the both sides of the charger 22.

Further, since colors of the pair of spacers 22*e* and 22*f* are changed and therefore, erroneous assembling can be prevented.

<Fourth Embodiment>

Figure 8A:
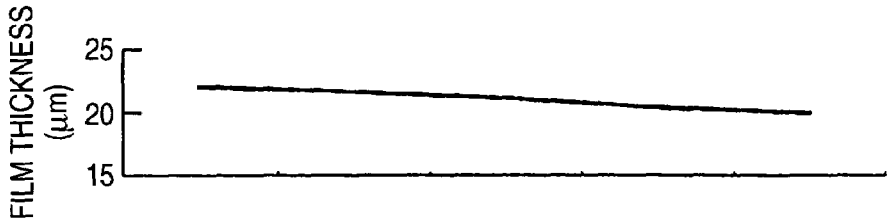
FIGS. 8A through 8C are views showing an essential portion of a fourth embodiment.
Figure 8B:
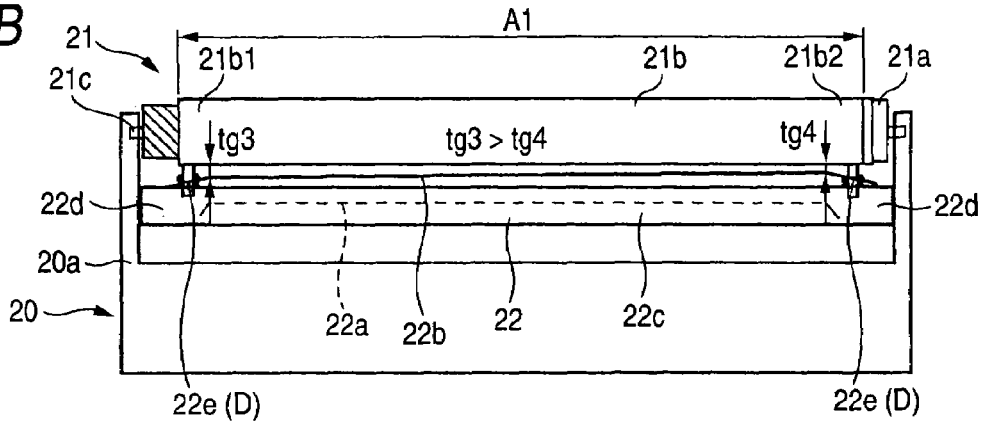
Figure 8C:
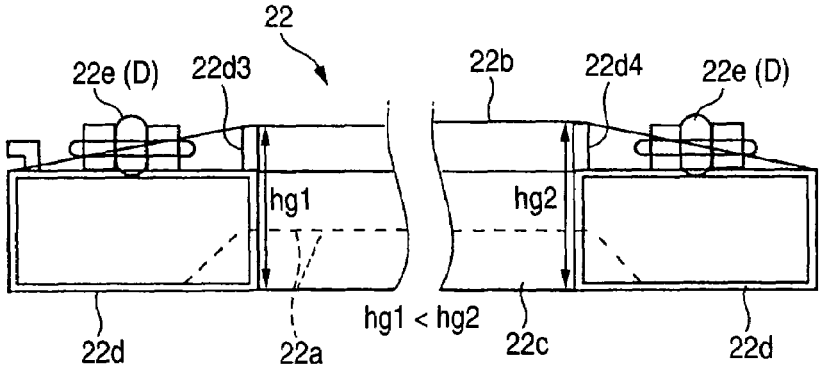

FIGS. 8A through 8C are views showing an essential portion of a fourth embodiment of the image forming apparatus according to the invention, FIG. 8A is a graph showing a change in the film thickness of the photosensitive layer 21*b* in the axis line direction of the photosensitive body 21, FIG. 8B is an outline view of the image carrier unit 20 and FIG. BC is a partially omitted enlarged view of FIG. 8B. In the drawings, portions the same as or in correspondence with those of the above-described first embodiment are attached with the same notations.

A point of the embodiment which differs from the above-described first embodiment resides in that by changing heights of grid supporting portions 22*d*3 and 22*d*4 for supporting both sides of the grid 22*b*, an interval between the grid 22*b* and the surface of the photosensitive body is narrowed on the side of the dip upper portion 21*b*2 of the photosensitive body 21 and widened on the side of the dip lower portion 21*b*1 thereof and the other points remain unchanged.

As shown by FIG. 8C, the grid supporting portions 22*d*3 and 22*d*4 are respectively provided at the supporting members 22*d* on both sides and by making a height hg2 of the grid supporting portion 22*d*4 on the side of the dip upper portion 21*b*2 of the photosensitive body 21 slightly higher than a height hg1 of the grid supporting portion 22*d*3 on the side of the dip lower portion 21$b$1, the interval between the grid 22$b$ and the surface of the photosensitive body is narrowed on the side of the dip upper portion 21$b$2 of the photosensitive body 21 and widened on the side of the dip lower portion 21$b$1 thereof.

Although the both sides of the charger 22 are provided with the pair of spacers 22$e$, 22$e$ for rectifying the interval between the surface of the photosensitive body 21 and the charger 22 by being brought into contact with the surface of the photosensitive body 21 similar to the above-described third embodiment, the spacers 22$e$, 22$e$ according to the embodiment are provided with the same diameter (D) and the charger 22 per se is not inclined.

Operation and effect similar to those of the above-described third embodiment are achieved also by the embodiment.

Further, according to the embodiment, it is not necessary to incline the charger 22 per se and therefore, assembling performance is promoted.

<Fifth Embodiment>

Figure 9A:
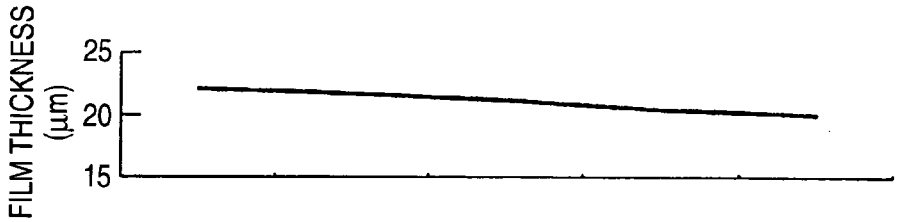
FIGS. 9A through 9C are views showing an essential portion of a fifth embodiment.
Figure 9B:
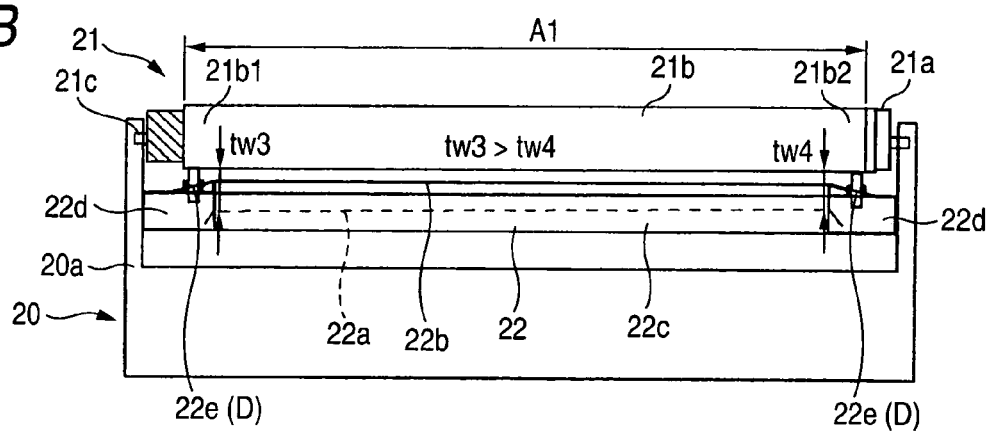
Figure 9C:
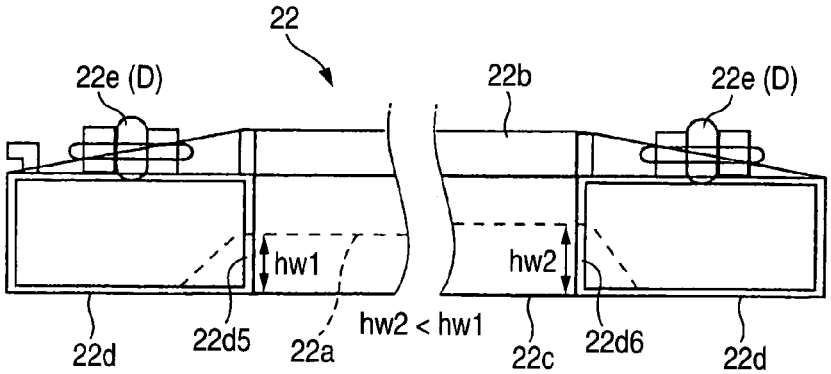

FIGS. 9A through 9$c$ are views showing an essential portion of a fifth embodiment of the image forming apparatus according to the invention, FIG. 9A is a graph showing a change in the film thickness of the photosensitive layer 21$b$ in the axis line direction of the photosensitive body 21, FIG. 9B is an outline view of the image carrier unit 20 and FIG. 9C is a partially omitted enlarged view of FIG. 9B. In the drawings, portions the same as or in correspondence with those of the above-described fourth embodiment are attached with the same notations.

A point of the embodiment which differs from the above-described fourth embodiment resides in that by not changing the heights of the grid supporting portions but changing heights of electrode supporting portions 22$d$5 and 22$d$6 for supporting both sides of the discharge electrode 22$a$, the interval between the discharge electrode 22$a$ and the surface of the photosensitive body is narrowed on the side of the dip upper portion 21$b$2 of the photosensitive body 21 (the interval is designated by notation tw4) and widened on the side of the dip lower portion 21$b$1 (the interval is designated by notation tw3) and the other points remain unchanged.

As shown by FIG. 9C, the electrode supporting portions 22$d$5 and 22$d$6 are respectively provided at the supporting members 22$d$ on both sides and by making a height hw2 of the electrode supporting portion 22$d$6 on the side of the dip upper portion 21$b$2 of the photosensitive body 21 slightly higher than a height hw1 of the electrode supporting portion 22$d$5 on the side of the dip lower portion 21$b$1, the interval between the discharge electrode 22$a$ and the surface of the photosensitive body is narrowed on the side of the dip upper portion 21$b$2 of the photosensitive body 21 and widened on the side of the dip lower portion 21$b$1.

Operation and effect similar to those of the above-described fourth embodiment are achieved also by the embodiment.

Further, according to the embodiment, for example, by constituting tw3−tw4=0.5 mm, the charge potential difference of 12V by the film thickness deviation of 2 $\mu$m can be canceled.

<Sixth Embodiment>

Figure 10A:
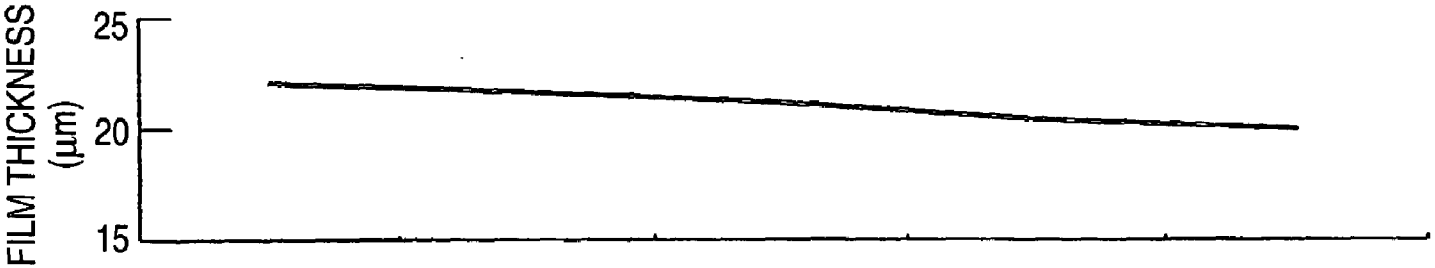
FIG. 10A and FIG. 10B are views showing an essential portion of a sixth embodiment.
Figure 10B:
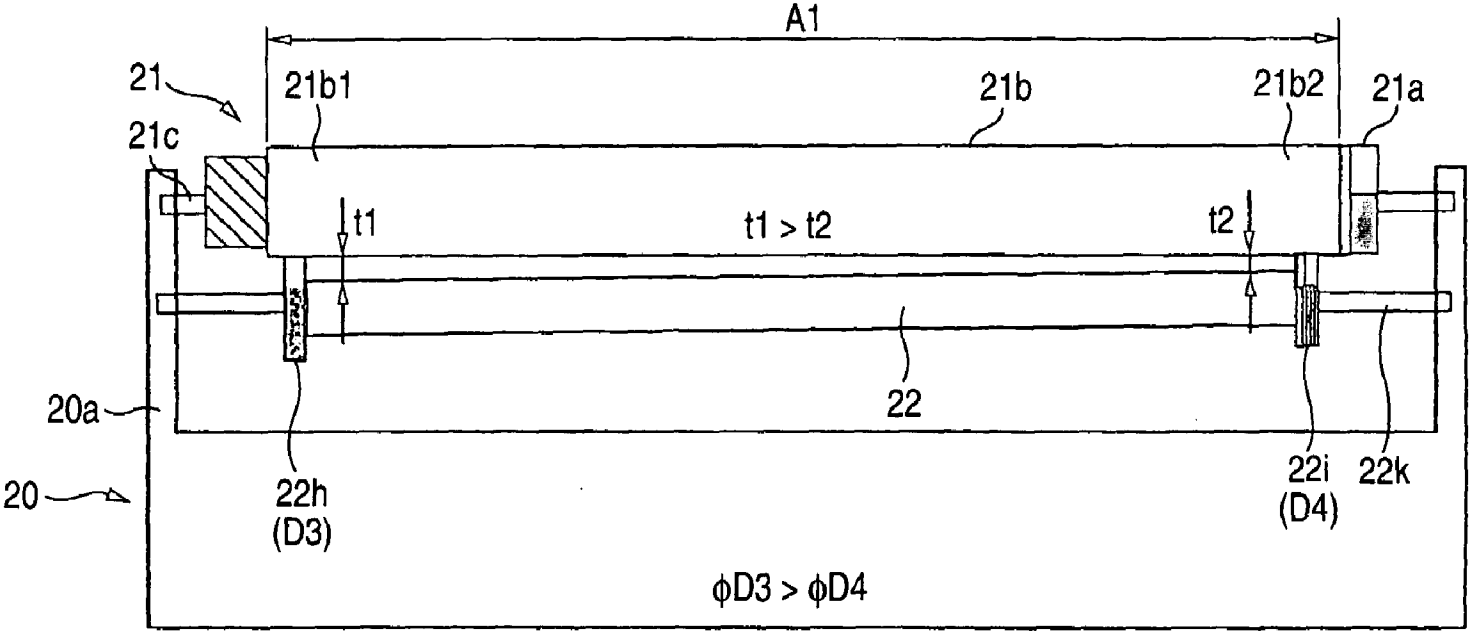

FIGS. 10A and 10B are views showing an essential portion of a sixth embodiment of the image forming apparatus according to the invention, FIG. 10A is a graph showing a change in the film thickness of the photosensitive layer 21$b$ in the axis line direction of the photosensitive body 21 and FIG. 10B is an outline view of the image carrier unit 20. In the drawings, portions the same as or in correspondence with those of the above-described first embodiment are attached with the same notations.

A point of the embodiment which differs from the above-described first embodiment resides in that the charger 22 is a charger in a shape of a roller, which is provided with a pair of spacer 22$h$ and 22$i$ brought into contact with the surface of the photosensitive body 21 on both sides thereof for rectifying the interval between the surface of the photosensitive body 21 and the charger 22 and the other points remain unchanged.

The pair of spacers 22$h$ and 22$i$ are provided with different colors.

The spacers 22$h$ and 22$i$ are in a ring-like shape and may be fixed to a shaft 22$k$ of the charger 22 in the shape of the roller or may be provided thereto rotatably.

According to the embodiment, by making a diameter D4 of the spacer 22$i$ brought into contact with the side of the dip upper portion 21$b$2 slightly smaller than a diameter D3 of the spacer 22$h$ brought into contact with the side of the dip lower portion 21$b$1 of the photosensitive body 21, the total of the charger 22 (an axis line of charger in the shape of the roller) is slightly inclined to the axis line of the photosensitive body 21 and an interval between a surface of the roller and the surface of the photosensitive body 21 is narrowed on the side of the dip upper portion 21$b$2 of the photosensitive body 21 (the interval is designated by notation t2) and widened on the side of the dip power portion 21$b$1 (the interval is designated by notation t1).

Operation and effect of (a) of the above-described first embodiment are achieved also by the embodiment.

Further, the uniform formation of the charge potential can further accurately be achieved by providing the pair of spacers 22$h$ and 22$i$ for rectifying the interval between the surface of the photosensitive body 21 and the charger 22 by being brought into contact with the surface of the photosensitive body 21 on the both sides of the charger 22.

For example, by constituting t1−t2=0.02 mm, the charge potential difference of 12V by the film thickness deviation of 2 $\mu$m can be canceled.

Further, since colors of the pair of spacers 22$h$ and 22$i$ are changed, erroneous assembling thereof can be prevented.

<Seventh Embodiment>

Figures 11A, 11B:
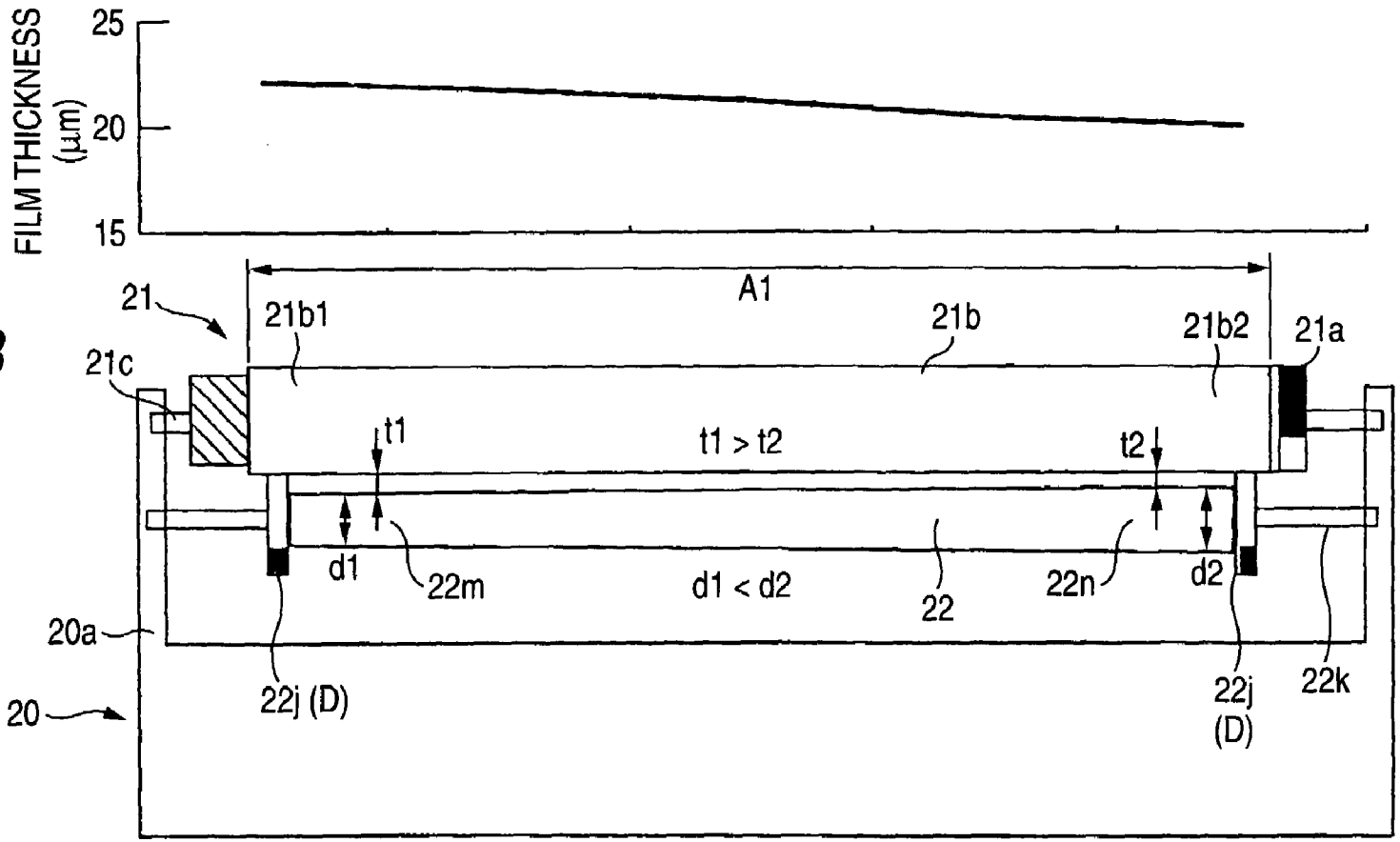
FIG. 11A and FIG. 11B are views showing an essential portion of a seventh embodiment.

FIGS. 11A and 11B are views showing an essential portion of a seventh embodiment of the image forming apparatus according to the invention, FIG. 11A is a graph showing a change in the film thickness of the photosensitive layer 21$b$ in the axis line direction of the photosensitive body 21 and FIG. 11B is an outline view of the image carrier unit 20. In the drawings, portions the same as or in correspondence with those of the above-described first embodiment are attached with the same notations.

A point of the embodiment which differs from the above-described first embodiment resides in that the charger 22 is a charger having a shape of a roller and the shape of the roller is constituted by a taper shape having a large diameter d2 on the side of the dip upper portion 21$b$2 of the photosensitive body 21 and a small diameter d1 on the dip lower portion side and the outer points remain unchanged.

The roller 22 is tapered by forming a surface layer thereof by dipping.

Further, a dip upper side 22$m$ of the roller 22 formed with the surface layer by dipping in this way is arranged to be opposed to the side of the dip lower portion 21$b$1 of the photosensitive body 21 and a dip lower portion side 22$n$ is arranged to be opposed to the side of the dip upper portion 21*b*2 of the photosensitive body 21.

As a result of constituting the shape of the roller of the charger 22 by the taper shape having the large diameter d2 on the side of the dip upper portion 21*b*2 of the photosensitive body 21 and having the small diameter d1 on the dip lower side, the interval between the surface of the roller charger and the surface of the photosensitive body 21 is narrowed on the side of the dip upper portion 21*b*2 of the photosensitive body 21 (the interval is designated by notation t2) and widened on the side of the dip lower portion 21*b*1 (the interval is designated by notation t1).

Although a pair of spacers 22*j*, 22*j* for rectifying the interval between the surface of the photosensitive body 21 and the charger 22 by being brought into contact with the surface of the photosensitive body 21 similar to the above-described sixth embodiment, the spacers 22*j*, 22*j* according to the embodiment are provided with the same diameter (D) and the charger 22 per se is not inclined.

Operation and effect similar to those of the above-described sixth embodiment are achieved also by the embodiment.

Further, according to the embodiment, it is not necessary to incline the charger 22 per se and therefore, assembling performance thereof is promoted.

Further, since the taper is attached by forming the surface layer of the roller charger 22 by dipping, a small taper (taper inclined reverse to the photosensitive layer 21*b*) can be attached and the uniform formation of the charge potential can further accurately be achieved.

<Eighth Embodiment>

According to the embodiment, the aperture rate of the grid is made to be large on the dip upper portion side of the photosensitive body and small on the dip lower portion side.

Figure 12A:
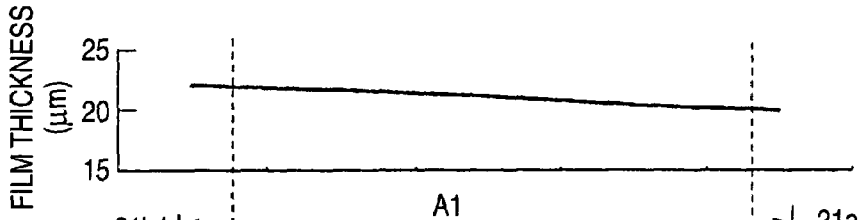
FIG. 12A through FIG. 12E are views showing an essential portion of an eighth embodiment.
Figure 12B:
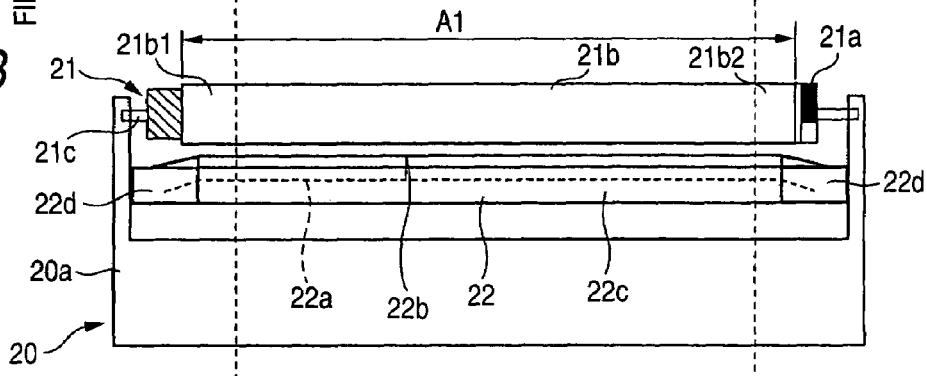
Figure 12C:
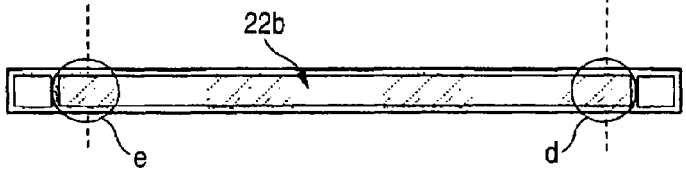
Figure 12D:
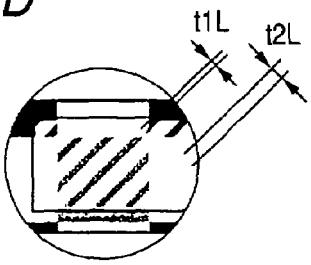
Figure 12E:
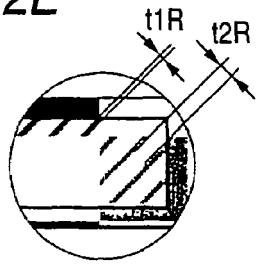

FIG. 12A through FIG. 12E are views showing an essential portion of the embodiment, FIG. 12A is a graph showing a change in the film thickness of the photosensitive layer 21*b* in the axial line direction of the photosensitive body 21, FIG. 12A is an outline view of the image carrier unit 20, FIG. 12C is a plane view of the grid, FIG. 12D is an enlarged view of portion d of FIG. 12C and FIG. 12E is an enlarged view of portion e of FIG. 12C.

As shown by FIG. 12B, the charger 22 of the embodiment is a scorotron charger having the discharge electrode 22*a* in the wire-like shape, the back plate 22*c* for carrying stable discharge and the grid 22*b* for controlling the charge potential on the photosensitive body 21 and as shown by FIGS. 12C through 12E, the aperture rate of the grid 22*b* is made to be large on the side of the dip upper portion 21*b*2 of the photosensitive body 21 and small on the side of the dip lower portion 21*b*1.

For example, as shown by FIG. 12D, at a portion opposed to the side of the dip upper portion 21*b*2 of the photosensitive body 21 (portion d), an aperture width t2R is made to be large by making a width t1R of an electrode of the grid 22*b* comparatively small and as shown by FIG. 12E, at a portion opposed to the side of the dip lower portion 21*b*1 (portion e), an aperture width t2L is made to be relatively small by making a width t1L of the electrode of the grid 22*b* comparatively large, thereby, the aperture rate of the grid 22*b* is made to be large on the side of the dip upper portion 21*b*2 of the photosensitive body 21 and small on the side of the dip lower portion 21*b*1.

When the aperture rate of the grid 22*b* is increased, charge function (function of charging the photosensitive body 21) is increased and when the aperture rate is reduced, also the charge function is reduced.

Therefore, the charge function of the above-described charger 22 is made to be large on the side of the dip upper portion 21*b*2 of the photosensitive body 21 and small on the dip lower portion side 21*b*1.

Further, in FIG. 12B, notation 20*a* designates the case of the image carrier unit 20 and the photosensitive body 21 is rotatably supported by the unit case 20*a* at the shaft 21*c* and is driven to rotate the drive mechanism, not illustrated. Notation A1 designates a photosensitive layer coating region.

The charger 22 is attached to the unit case 20*a*. Notation 22*d* designates the pair of left and right supporting members for supporting the discharge electrode 22*a* and the grid 22*b* and attached to the both end portions of the black plate 22*c*.

The above-described image forming apparatus is provided with the photosensitive body 21 coated with the photosensitive layer 21*b* by dipping and the scorotron charger 22 having the discharge electrode 22*a* and the grid 22*b* opposed to the photosensitive body 21 for charging the surface of the photosensitive body 21, the aperture rate of the grid 22*b* is made to be large on the side of the dip upper portion 21*b*2 of the photosensitive body 21 and small on the dip lower side 21*b*1 and therefore, according to the image forming apparatus, uniform formation of the charge potential of the surface of the photosensitive body can be achieved.

That is, by constructing the above-described constitution, the uniform formation of the charge potential can be achieved by canceling the charge potential difference on the photosensitive body which is to be brought about when the distance between the discharge electrode and the surface of the photosensitive body is maintained constant or the aperture pattern of the grid is formed to constitute an isotropic aperture rate in the direction of moving the photosensitive body, assumedly as in the above-described related arts.

Figure 13:
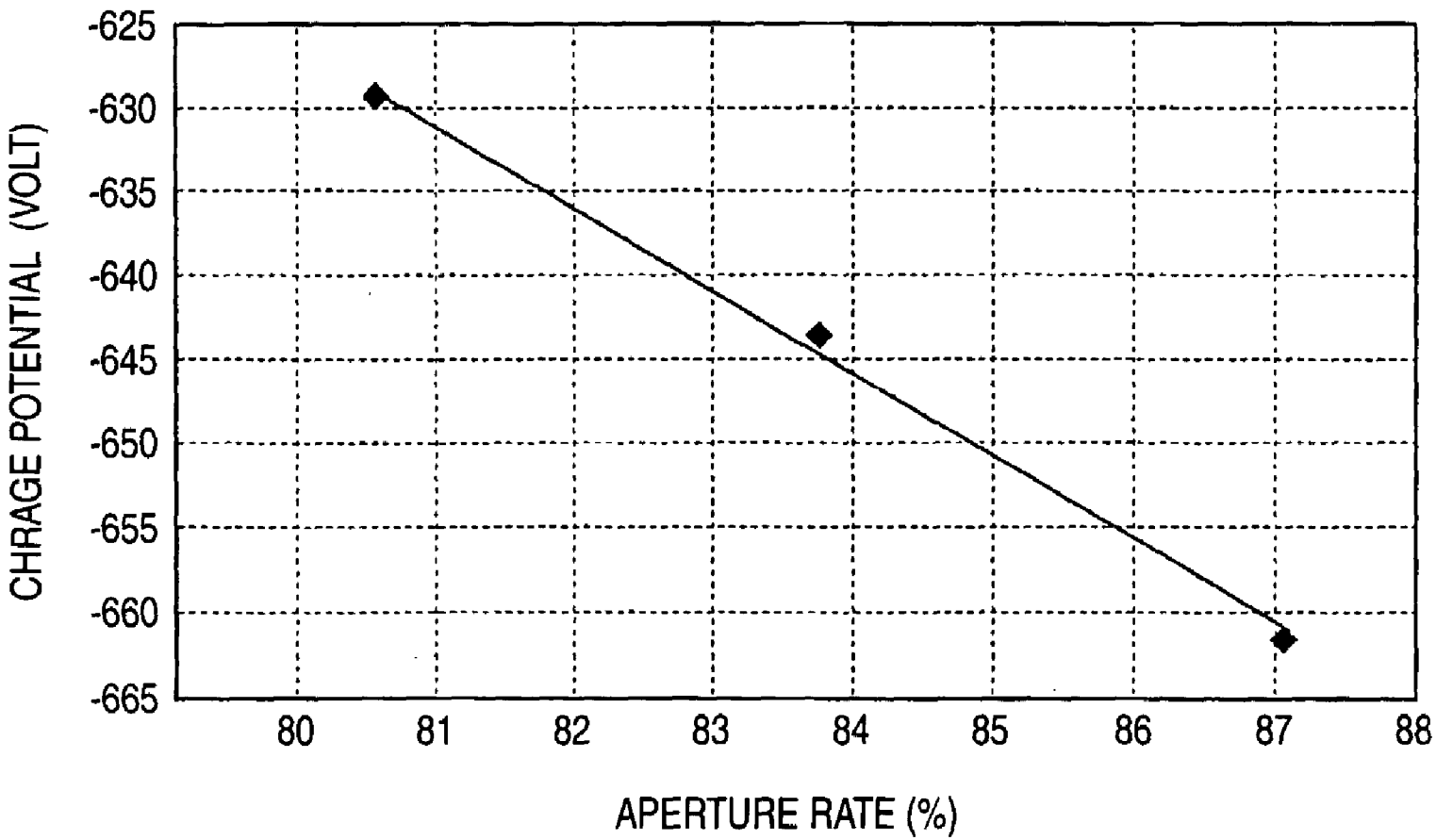
FIG. 13 is a view of a graph showing an example of a relationship between an aperture rate of a grid and a charge potential.

FIG. 13 is a graph showing a relationship between the aperture rate of the grid and the charge potential.

As is known from the graph, when the aperture rate of the grid is widened by 1%, an absolute value of the large potential is increased by about 5V.

Therefore, for example, by constituting t1R and t2R by t1R=0.16 mm and t2R=1.00 mm to constitute the aperture rate of the grid 22*b* in correspondence with the dip upper portion 21*b*2 to be 86.2% and constituting t1L and t2L to be t1L=0.19 mm and t2L=1.00 mm to constitute the aperture rate of the grid 22*b* in correspondence with the dip lower portion 21*b*1 to be 84%, the charge potential difference of 12V by the film thickness deviation 2 $\mu$m can be canceled.

Further, by increasing the aperture rate of the grid 22*b* substantially linearly from the portion opposed to the dip lower portion 21*b*1 to the portion opposed to the dip upper portion 21*b*2, the above-described charge potential difference on the photosensitive body can accurately be canceled.

<Ninth Embodiment>

According to a ninth embodiment and a tenth embodiment, the aperture rate of the back plate is made to be small on the dip upper portion side of the photosensitive body and large on the dip lower portion side.

Figure 14A:
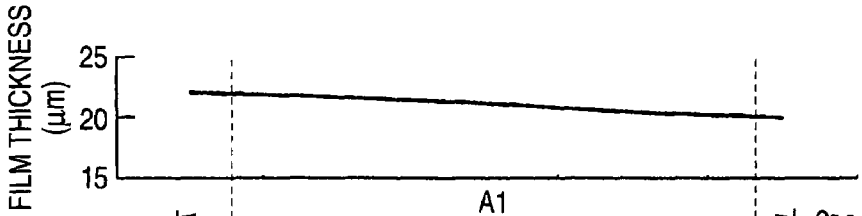
FIG. 14A through FIG. 14E are views showing an essential portion of a ninth embodiment.
Figure 14B:
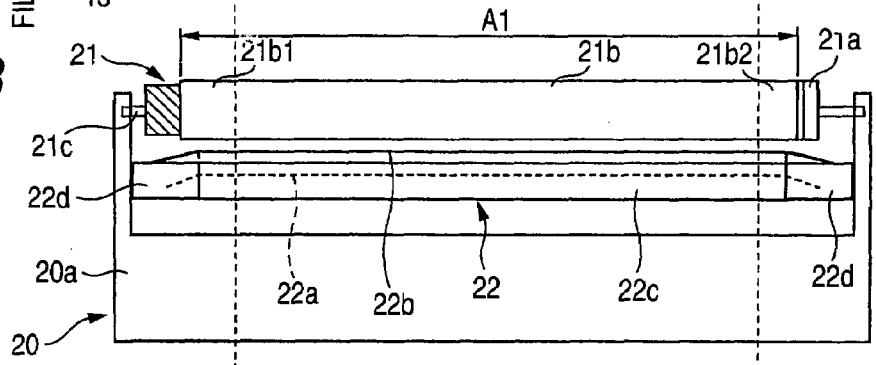
Figure 14C:
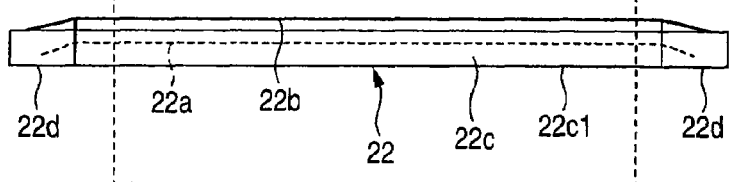
Figure 14D:
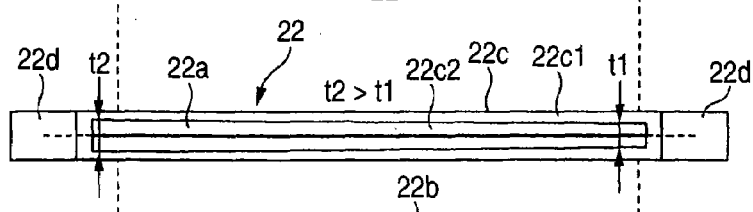
Figure 14E:
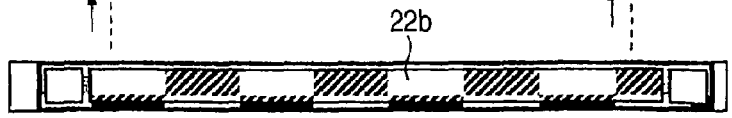

FIG. 14A through FIG. 14E are views showing an essential portion of the ninth embodiment, FIG. 14A is a graph showing a change in the film thickness of the photosensitive layer 21*b* in the axis line direction of the photosensitive body 21, FIG. 14B is an outline view of the image carrier unit 20, FIG. 14C is a front view of the charger 22, FIG. 14D is a bottom view of the charger 22 and FIG. 14E is a plane view of the charger 22.

As shown by FIG. 14B and FIG. 14C, the charger 22 of the embodiment is a scorotron charger having the discharge electrode 22*a* in the wire-like shape, the back plate 22*c* for carrying out stable discharge and the grid 22*b* for controlling the charge potential on the photosensitive body 21. As shown by FIG. 14D, the charger 22 is provided with an aperture 22*c*2 in an elongated trapezoidal shape at a bottom plate portion 22*c*1 of the back plate 22*c* and by making an aperture width t1 opposed to the dip upper portion side 21*b*2 of the photosensitive body 21 small and making an aperture width t2 opposed to the dip lower portion side 21*b*1 large, the aperture rate of the back plate 22*c* is made to be small on the side of the dip upper portion 21*b*2 of the photosensitive body 21 and large on the dip lower portion side 21*b*1.

When the aperture rate of the back plate 22*c* is made to be large, an amount of discharge by the charger 22 is reduced and when the aperture rate is made to be small, the amount of discharge by the charger 22 is increased.

Therefore, the charge function by the above-described charger 22 (function of charging the photosensitive body 21) is large on the side of the dip upper portion 21*b*2 of the photosensitive body 21 and small on the dip lower portion side 21*b*1.

Further, in FIG. 14B, notation 20*a* designates the case of image carrier unit 20 and the photosensitive body 21 is rotatably supported by the unit case 20*a* at the shaft 21*c* and driven to rotate by a drive mechanism, not illustrated. Notation A1 designates the photosensitive layer coating region.

The charger 22 is attached to the unit case 20*a*. Notation 22*d* designates the pair of left and right supporting members for supporting the discharge electrode 22*a* and the grid 22*b*, which are attached to the both end portions of the back plate 22*c*.

The above-described image forming apparatus is provided with the photosensitive body 21 coated with the photosensitive layer 21*b* by dipping and the charger 22 having the discharge electrode 22*a* and the back plate 22*c* opposed to the photosensitive body 21 for charging the surface of the synthesized member, the aperture rate of the back plate 22*c* is made to be small on the dip upper portion side 21*b*2 of the photosensitive body 21 and large on the dip lower portion side 21*b*2 and therefore, according to the image forming apparatus, the uniform formation of the charge potential on the surface of the photosensitive body can be achieved.

That is, by constructing the above-described constitution, the uniform formation of the charge potential can be achieved by canceling the charge potential difference on the photosensitive body which is to be brought about when the distance between the discharge electrode and the surface of the photosensitive body is maintained constant or the aperture pattern of the grid is formed to constitute an isotropic aperture rate in the direction of moving the photosensitive body, assumedly as in the above-described related arts.

<Tenth Embodiment>

Figure 15A:
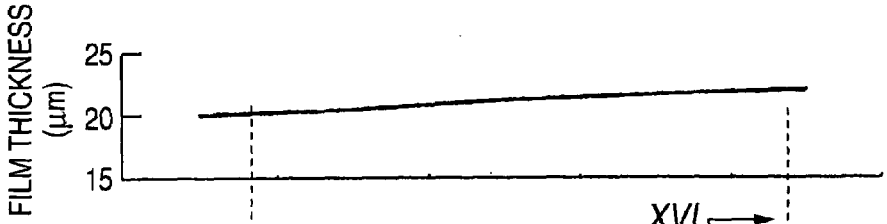
FIG. 15A through FIG. 15E are views showing an essential portion of a tenth embodiment.
Figure 15B:
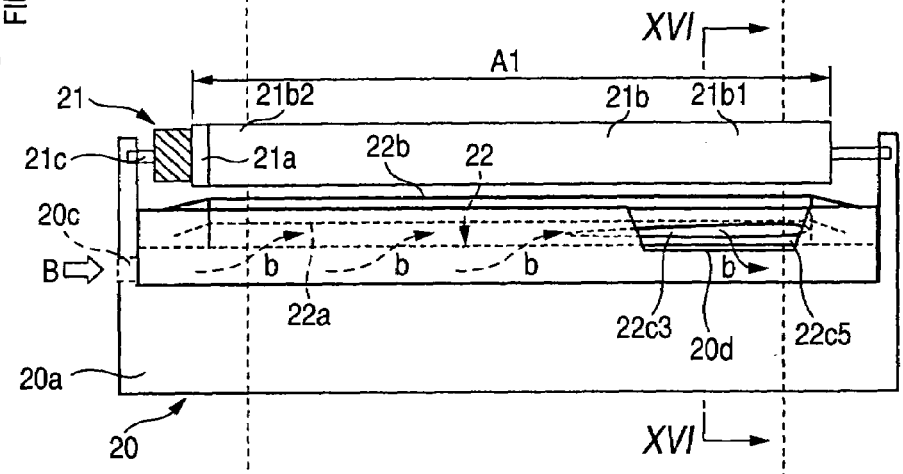
Figure 15C:
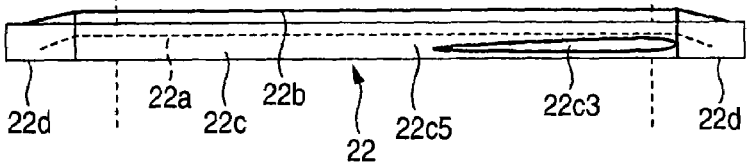
Figure 15D:
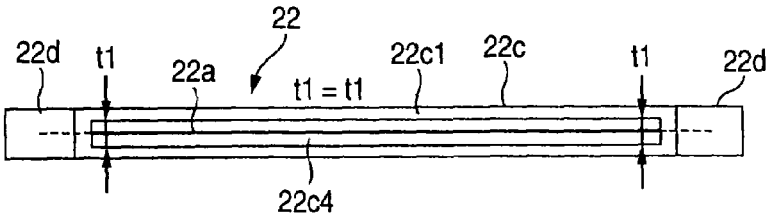
Figure 15E:
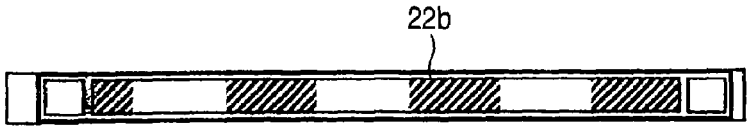
Figure 16:
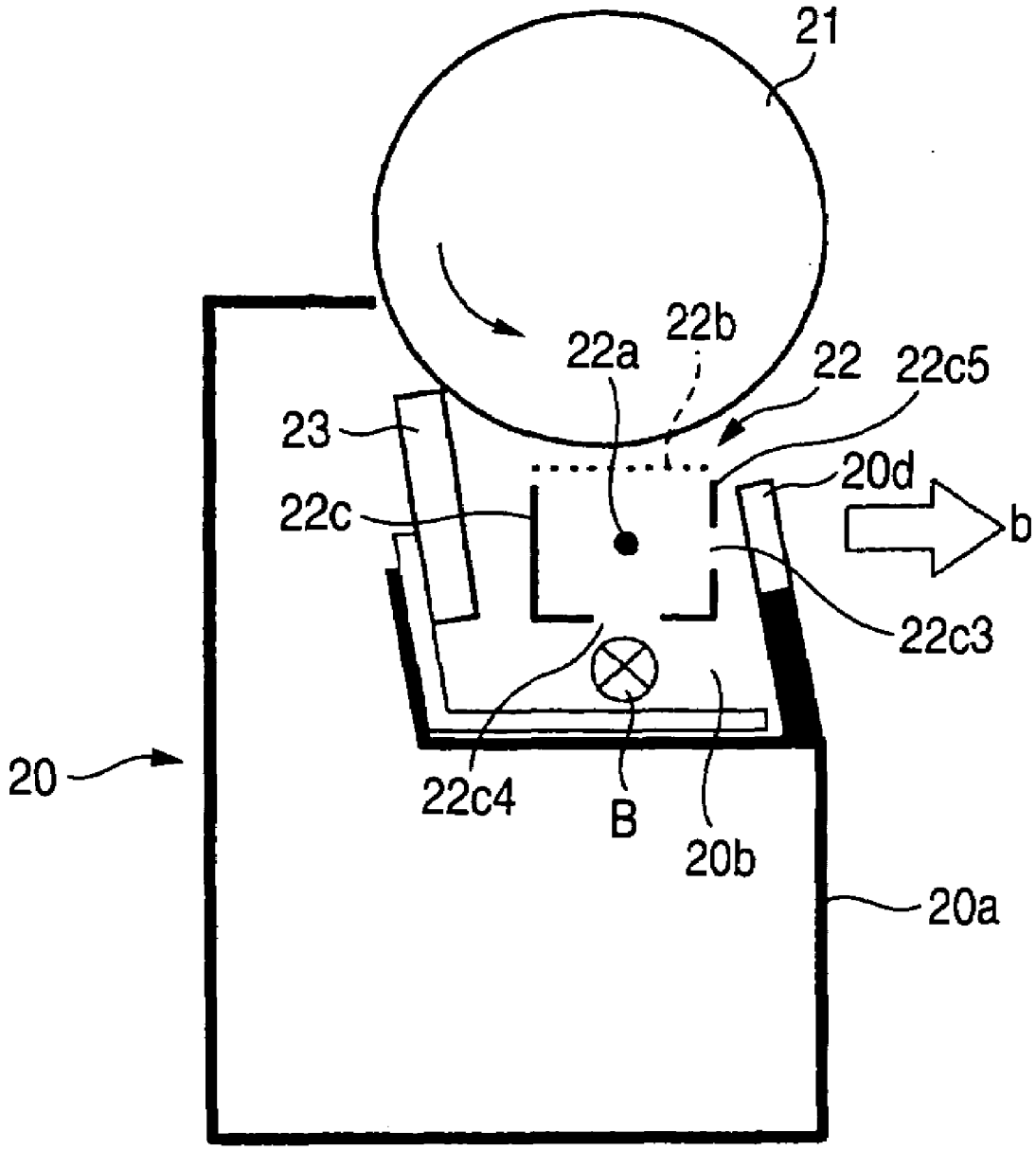
FIG. 16 is a sectional view (outline view) taken along a line XVI—XVI of FIG. 15B.

FIG. 15A through FIG. 15E are views showing an essential portion of a tenth embodiment of the image forming apparatus according to the invention, FIG. 15A is a graph showing a change in the film thickness of the photosensitive layer 21*b* in the axis line direction of the photosensitive body 21, FIG. 15B is an outline left side view of the image carrier unit 20, FIG. 15C is a front view of the charger 22 when the front view is constituted by FIG. 15B, FIG. 15D is similarly a bottom view of the charger 22 and FIG. 15E is similarly a plane view of the charger 22. FIG. 16 is a sectional view (outline view) taken along a line XVI—XVI of FIG. 15B. In the drawings, portions the same as or in correspondence with those of the above-described ninth embodiment are attached with the same notations.

The characteristic of the embodiment resides in that air at inside of the charger 22 is discharged by making an airflow B flow along the back plate 22*c*, the photosensitive body 21 is arranged such that the dip upper portion 21*b*2 is disposed on the upstream side of the airflow B and the dip lower portion 21*b*1 is disposed on the downstream side of the airflow B and by providing an aperture 22*c*3 for passing air at the back plate 22*c*, the aperture rate of the back plate 22*c* is made to be small on the side of the dip upper portion 21*b*2 of the photosensitive body 21 and large on the side of the dip lower portion 21*b*1.

The aperture 22*c*3 for passing air is provided at one side plate portion 22*c*5 of the back plate 22*c* at a portion of the photosensitive body 21 opposed to the dip lower portion 21*b*1.

As shown also by FIG. 16, the case 20*a* of the image carrier unit 20 is provided with a duct 20*b*. The duct 20*b* is provided in a section substantially in a U-like shape to surround a lower side of the charger 22, provided with a flow inlet 20*c* (refer to FIG. 15B) on one end side thereof (side of the dip upper portion 21*b*2 of the photosensitive body 21) and provided with a discharge port 20*d* on other end side (side of the dip lower portion 21*b*1 of the photosensitive body 21).

Although as shown by FIG. 15D, the bottom plate portion 22*c*1 of the back plate 22*c* of the charger 22 of the embodiment is provided with an aperture 22*c*4, the opening 22*c*4 is constituted by a rectangular shape and is not constituted by an elongated trapezoidal shape as in the aperture 22*c*2 according to an ninth embodiment. That is, the opening 22*c*4 is for introducing the airflow B into the charger 22 and as shown by an arrow mark b in FIG. 15B, the airflow b is brought from the opening 22*c*4 into the charger 22 and discharged to outside of the image carrier unit 20 via the aperture 22*c*3 at the side portion and the discharge port 20*d* of the duct.

According to the embodiment, discharge of air is carried out by making the airflow B flow along the back plate 22*c* and therefore, ozone is discharged from inside of the charger 20 by discharging air.

Therefore, stable charging operation is achieved by preventing a deterioration of the discharge electrode 22*a* by stagnation of ozone. Further, also a deterioration of photosensitive body 21 by stagnation of ozone can also be prevented.

Further, by arranging the photosensitive body 21 such that the dip upper portion 21*b*2 is disposed on the upstream side of the airflow B and the dip lower portion 21*b*1 is disposed on the downstream side of the airflow B and providing the aperture 22*c*3 for passing air at the back plate 22*c*, the aperture rate of the back plate 22*c* is made to be small on the dip upper portion side 21*b*2 of the photosensitive body 21 and large on the side of the dip lower portion 21*b*1 and therefore, the uniform formation of the charge potential on the surface of the photosensitive body can be achieved.

Further, by providing the aperture 22*c*3 for passing air on the side of the dip lower portion 21*b*1 of the photosensitive body 21, that is, on the downstream side of the airflow B, the flow of the airflow B is made to be smooth and ozone is further excellently discharged from inside of the charger 22.

<Eleventh Embodiment>

In an eleventh embodiment through a thirteenth embodiment, an insulator sheet is applied to an inner face of the back plate and a rate of applying the insulator sheet is made to be small on the dip upper portion side of the photosensitive body and large on the dip lower portion side.

Figure 17A:
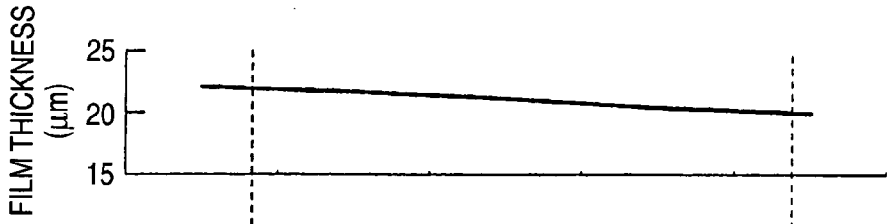
FIG. 17A through FIG. 17E are views showing an essential portion of an eleventh embodiment.
Figure 17B:
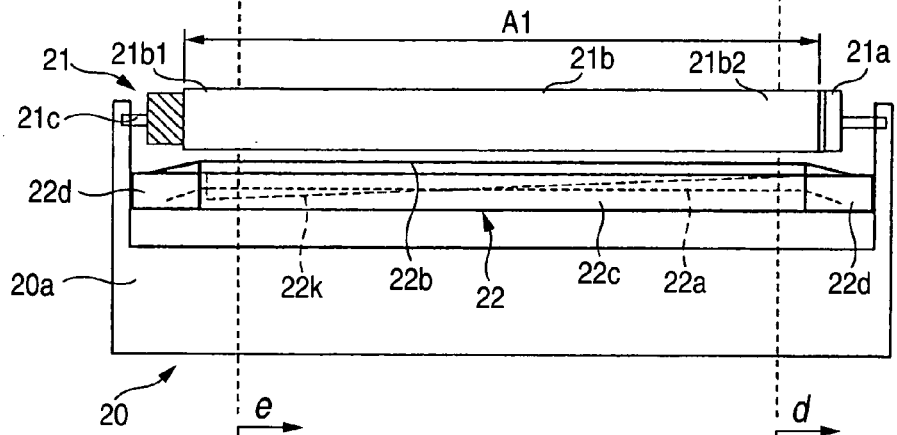
Figure 17C:
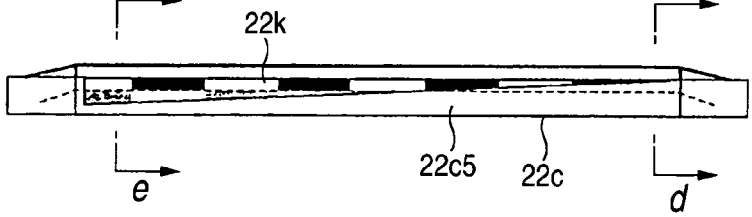
Figure 17E:
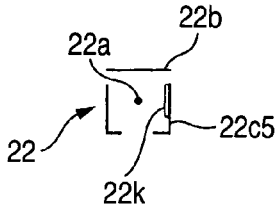
Figure 17D:
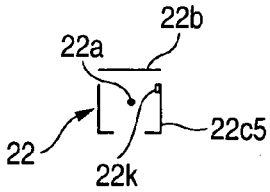

FIGS. 17A through 17E are views showing an essential portion of the embodiment, FIG. 17A is a graph showing a change in the film thickness of the photosensitive layer 21*b* in the axis line direction of the photosensitive body 21, FIG. 17B is an outline view of the image carrier unit 20, FIG. 17C is a front view of the charger 22, FIG. 17D is a sectional view taken along a line d—d of FIG. 17C and FIG. 17E is a sectional view taken along a line e—e of FIG. 17C.

As shown by FIGS. 17B and 17C, the charger 22 according to the embodiment is a scorotron charger having the discharge electrode 22*a* in the wire-like shape, the back plate 22*c* for carrying out stable discharge and the grid 22*b* for controlling the charge potential on the photosensitive body 21.

As is clearly shown in FIGS. 17C through 17E, an insulator sheet 22*k* in an elongated triangular shape a width of which is widened from the side of the dip upper portion 21*b*2 to the side of the dip lower portion 21*b*1 is pasted on an inner face of one side plate portion 22*c*5 of the back plate 22*c* (or an insulating coating is coated in the shape of the sheet 22*k*). As a result, the applying rate of the insulator sheet 22*k* is small on the side of the dip upper portion 21*b*2 of the photosensitive body 21 and large on the side of the dip lower portion 21*b*1.

When the insulator sheet is applied to the inner face of the back plate 22*c*, the amount of discharge at the applied portion is reduced.

Therefore, the charge function (function of charging the photosensitive body 21) by the above-described charger 22 is made to be large on the side of the dip upper portion 21*b*2 of the photosensitive body 21 and small on the dip lower portion side 21*b*1.

Further, in FIG. 17B, notation 20*a* designates the case of the image carrier unit 20, the photosensitive body 21 is rotatably supported by the unit case 20*a* at the shaft 21*c* and is driven to rotate by a drive mechanism, not illustrated. Notation A1 designates the photosensitive layer coating region.

The charger 22 is attached to the unit case 20*a*. Notation 22*d* designates the pair of left and right supporting members for supporting the discharge electrode 22*a* and the grid 22*b*, which are attached at the both end portions of the back plate 22*c*.

The above-described image forming apparatus is provided with the photosensitive body 21 coated with the photosensitive layer 21*b* by dipping, and the charger 22 having the discharge electrode 22*a* opposed to the photosensitive body 21 for charging the surface of the photosensitive body and the back plate 22*c* and the insulator sheet 22*k* applied to the inner face of the back plate 22, the applying rate of the insulator sheet 22*k* is made to be small on the side of the dip upper portion 21*b*2 of the photosensitive body 21 and large on the side of the dip lower portion 21*b*1 and therefore, the uniform formation of the charge potential on the surface of the photosensitive body can be achieved.

That is, by constructing the above-described constitution, the uniform formation of the discharge potential can be achieved by canceling the charge potential difference on the photosensitive body which is to be brought about when a constitution of maintaining the distance between the discharge electrode and the surface of the photosensitive body constant or the like is constructed, assumedly as in the above-described related arts.

<Twelfth Embodiment>

Figure 18A:
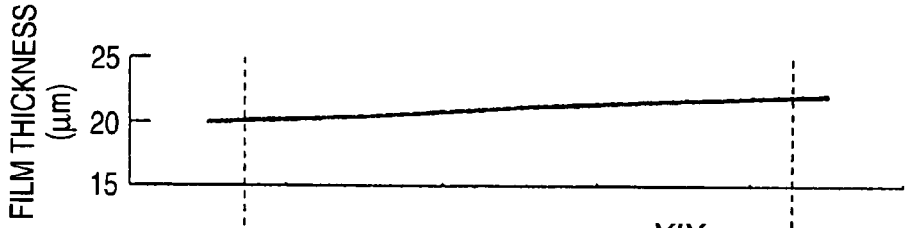
FIG. 18A through FIG. 18C are views showing an essential portion of a twelfth embodiment.
Figure 18B:
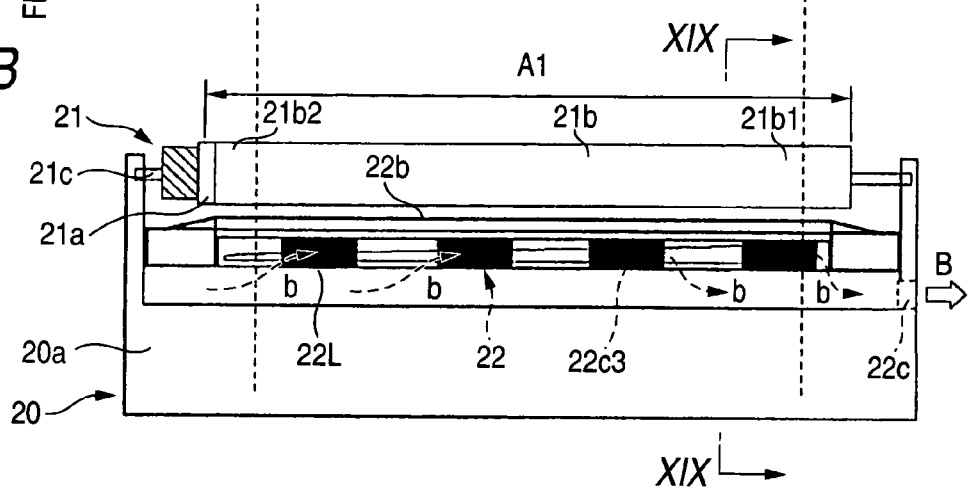
Figure 18C:
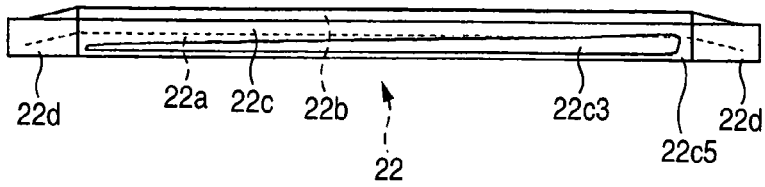
Figure 18D:
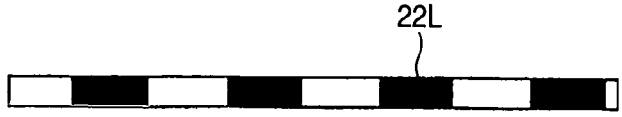
FIG. 18D is similarly a front view of an insulator sheet.

FIGS. 18A through 18C are views showing an essential portion of a twelfth embodiment of the image forming apparatus according to the embodiment, FIG. 18A is a graph showing a change in the film thickness of the photosensitive layer 21*b* in the axis line direction of the photosensitive body 21, FIG. 18B is an outline left side view of the image carrier unit 20, FIG. 18C is a front view of the charger 22 when the front view is constituted by FIG. 18B and FIG. 18D is similarly a front view of the insulator sheet 22*k*.

Figure 19:
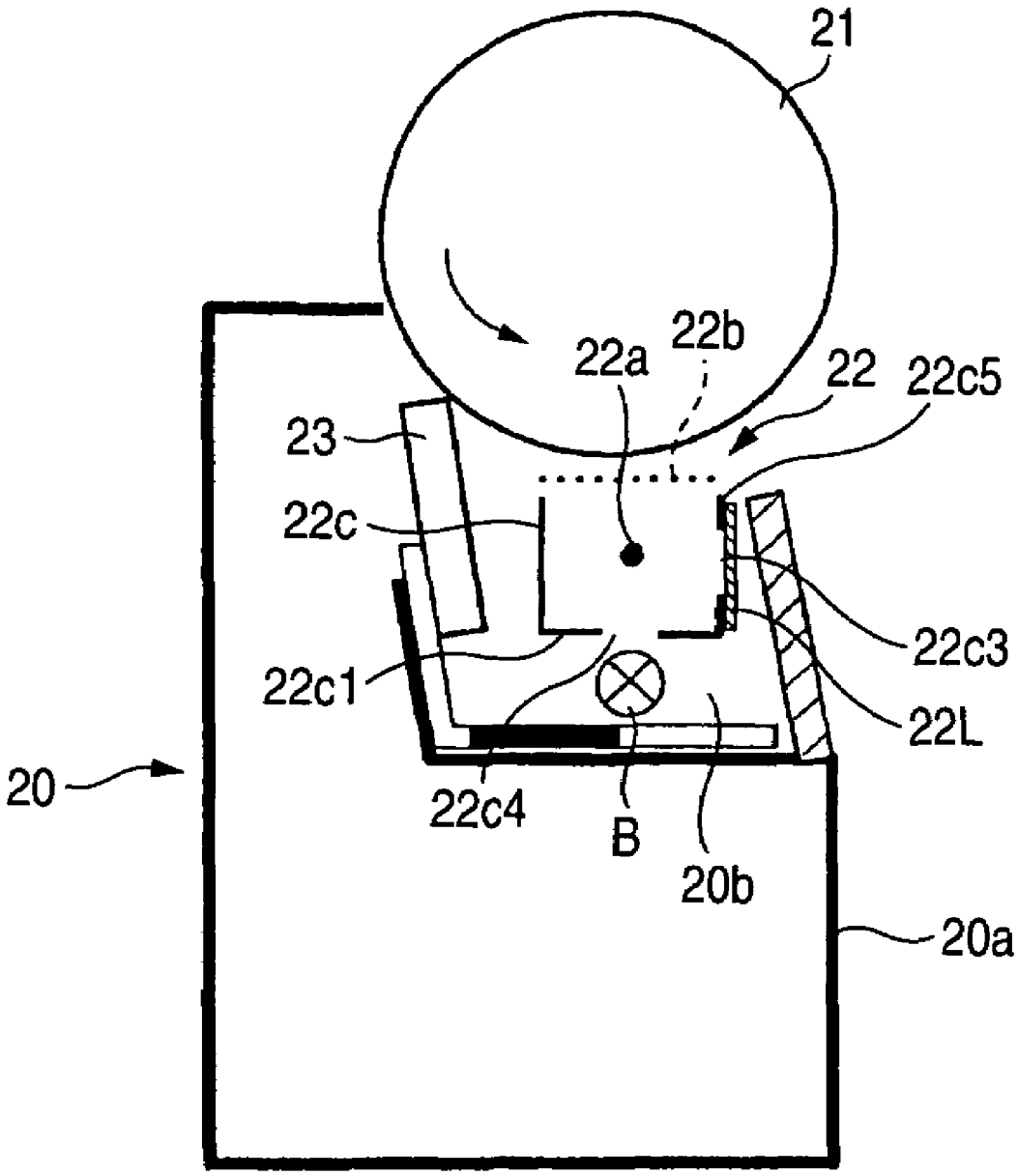
FIG. 19 is a sectional view (outline view) taken along a line XIX—XIX of FIG. 18B.

FIG. 19 is a sectional view (outline view) taken along a line XIX—XIX of FIG. 18B. In the drawings, portions the same as or in correspondence with those of the above-described eleventh embodiment are attached with the same notations.

The characteristic of the embodiment resides in that air at inside of the charger 22 is discharged by making an airflow B flow along the back plate 22*c*, the back plate 22*c* is provided with an aperture 22*c*3, an aperture rate thereof is made to be small on the side of the dip upper portion 21*b*2 of the photosensitive body 21 and large on the side of the dip lower portion 21*b*1 and the aperture 22*c*3 is closed by an insulator sheet 22L applied to an outer face of the back plate 22*c*.

The aperture 22*c*3 is provided at one side plate portion 22*c*5 of the back plate 22*c* and is similarly closed by the insulator sheet 22L pasted on the side plate portion 22*c*5.

As shown also in FIG. 19, the case 20*a* of the image carrier unit 20 is provided with the duct 20*b*. The duct 20*b* is provided to constitute a section thereof substantially in a U-like shape to surround the lower side of the charger 22 and one end side thereof (side of the dip lower portion 21*b*1 of the photosensitive body 21) is provided with a suction port 20*c* (refer to FIG. 18B) of air.

The bottom plate portion 22*c*1 of the back plate 22*c* is provided with an aperture 22*c*4 extended in a longitudinal direction (direction orthogonal to paper face of FIG. 19). Therefore, the airflow B is brought from the opening 22*c*4 into the charger 22 as shown by the arrow mark b in FIG. 18B, passes inside of the charger 22 and is discharged to outside of the image carrier unit 20 via the suction port 20*c*.

According to the embodiment, air is discharged by making the airflow B flow along the back plate 22*c* and therefore, ozone is discharged from inside of the charger 20 by discharging air.

Therefore, stable charging operation is achieved by preventing a deterioration of the discharge electrode 22*a* by stagnation of ozone. Further, also a deterioration of the photosensitive body 21 by stagnation of ozone is prevented.

Further, the back plate 22*c* is provided with the aperture 22*c*3, the aperture rate is made to be small on the side of the dip upper portion 21*b*2 of the photosensitive body and large on the side of the dip lower portion 21*b*1 and therefore, the uniform formation of the charge potential on the surface of the photosensitive body 21 can be achieved. That is, when the aperture rate of the back plate 22*c* is increased, the amount of discharge by the charger can be reduced. According to the embodiment, the aperture rate of the back plate 22*c* is made to be small on the side of the dip upper portion 21*b*2 of the photosensitive body 21 and large on the side of the dip lower portion 21*b*1 and therefore, the uniform formation of the charge potential on the surface of the photosensitive body can be achieved.

Further, the aperture 22c3 is closed by the insulator sheet 22L applied to the outer face of the back plate and therefore, disturbance of the airflow B by presence of the aperture 22c3 is prevented and unevenness of charge is also prevented.

<Thirteenth Embodiment>

Figure 20A:
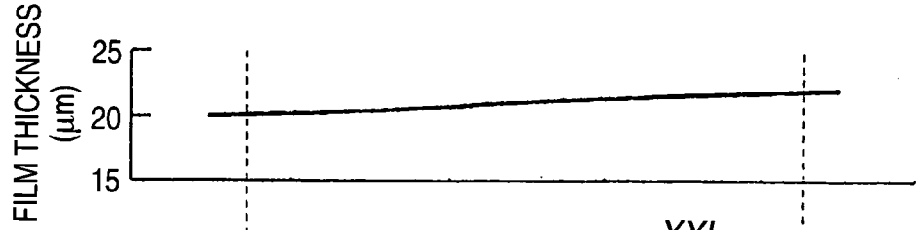
FIG. 20A through FIG. 20D are views showing an essential portion of a thirteenth embodiment.
Figure 20B:
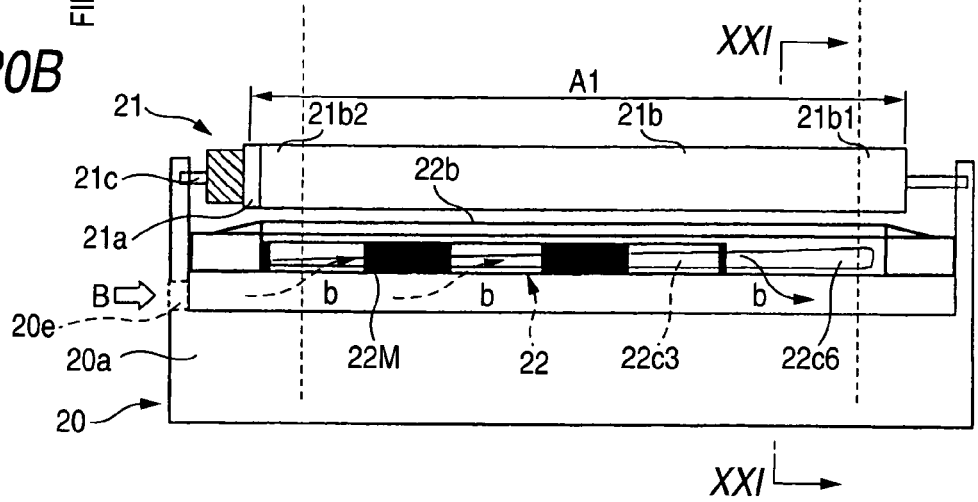
Figure 20C:
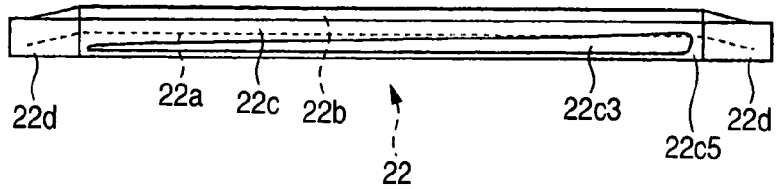
Figure 20D:
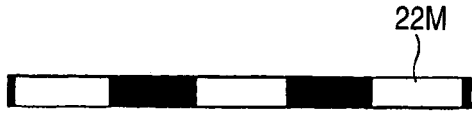

FIGS. 20A through 20D are views showing an essential portion of a thirteenth embodiment of the image forming apparatus according to the invention, FIG. 20A is a graph showing a change in the film thickness of the photosensitive layer 21b in the axis line direction of the photosensitive body 21, FIG. 20B is an outline left side view of the image carrier unit 20, FIG. 20C is a front view of the charger 22 when the front view is constituted by FIG. 20B and FIG. 20D is similarly a front view of an insulator sheet 22M.

Figure 21:
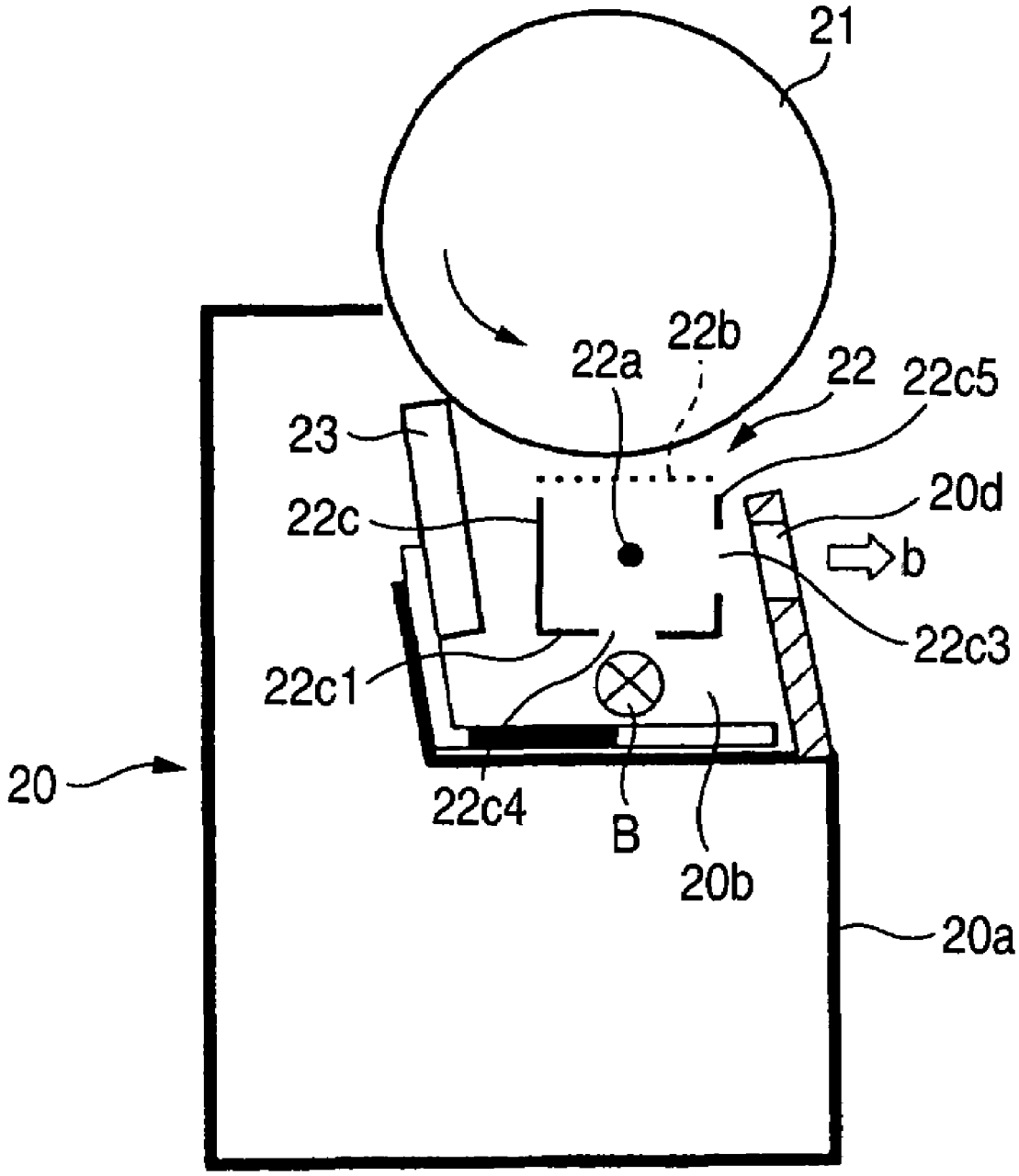
FIG. 21 is a sectional view (outline view) taken along a line XXI—XXI of FIG. 20B.

FIG. 21 is a sectional view (outline view) taken along a line XXI—XXI of FIG. 20B. In the drawings, portions the same as or in correspondence with those of the above-described twelfth embodiment are attached with the same notations.

A point of the embodiment which differs from the twelfth embodiment resides in that the aperture 22c3 of the back plate 22c is closed by an insulator sheet 22M (sheet shorter than the insulator sheet 22L) applied to the outer face of the back plate while leaving a portion 22c6 on the downstream side of the airflow B to constitute an aperture for passing air by the portion 22c6 and that in place of the suction port 20c of the duct 22b, a flow inlet (wind blowing port) 20e is provided on the side of the dip upper portion 21b2 of the photosensitive body 21 and the discharge port 20d is provided on the side of the lower portion 21b1 of the photosensitive body 21 and the other points remain unchanged.

Therefore, according to the embodiment, the airflow B is brought from the wind blowing port 20e into the charger 22 by passing the opening 22c4 as shown by the arrow mark b of FIG. 20B and is discharged to outside of the image carrier unit 20 via the air passing aperture 22c6 at the side portion and the discharge port 20d of the duct.

Also according to the embodiment, the dip upper portion 21b2 of the photosensitive body 21 is arranged to be disposed on the upstream side of the airflow B and the dip lower portion 21b1 is arranged to be disposed on the downstream side of the airflow B, the aperture rate of the back plate 22c is reduced on the side of the dip upper portion 21b2 of the photosensitive body 21 and increased on the side of the dip lower portion 21b1 and therefore, the uniform formation of the charge potential on the surface of the photosensitive body is achieved.

Further, the aperture 22c3 is closed by the insulator sheet 22M applied to the outer face of the back plate while leaving the portion 22c6 on the downstream side of the airflow B and therefore, by constituting the aperture for passing air by the portion 22c6 which is not closed in the aperture 22c3 and providing the air passing aperture 22c6 on the side of the dip lower portion 21b1 of the photosensitive body, that is, on the downstream side of the airflow B, the flow of the airflow B is made to be smooth and ozone is further excellently discharged from inside of the charger 22.

Although an explanation has been given of embodiments of the invention as described above, the invention is not limited to the above-described embodiments but can pertinently be modified within a range of the gist of the invention.

What is claimed is:

1. An image forming apparatus comprising:

a photosensitive body on which a photosensitive layer is provided; and a charger having a discharge electrode and a grid opposed to the photosensitive body for charging a surface of the photosensitive body, wherein an aperture rate of the grid is larger on a first side of the photosensitive body than on a second side thereof.

2. The image forming apparatus according to claim 1, wherein the photosensitive layer is formed by dipping.

3. The image forming apparatus according to claim 2, wherein the first side of the photosensitive body corresponds to an upper portion and the second side of the photosensitive body corresponds to a lower portion when the dipping is performed to the photosensitive body.

4. An image forming apparatus comprising:

a photosensitive body on which a photosensitive layer is provided; and a charger having a discharge electrode and a back plate having an aperture and opposed to the photosensitive body for charging a surface of the photosensitive body, wherein an aperture rate of the back plate is smaller on a first side of the photosensitive body than on a second side thereof.

5. The image forming apparatus according to claim 4, wherein the photosensitive layer is formed by dipping.

6. The image forming apparatus according to claim 5, wherein the first side of the photosensitive body corresponds to an upper portion and the second side of the photosensitive body corresponds to a lower portion when the dipping is performed to the photosensitive body.

7. The image forming apparatus according to claim 4, wherein an airflow is provided along the back plate so that air is discharged.

8. The image forming apparatus according to claim 7, wherein the photosensitive body is arranged such that a first side of the photosensitive body is disposed on an upstream side of the airflow and a second side of the photosensitive body is disposed on a downstream side of the airflow.

9. The image forming apparatus according to claim 4, wherein an insulator sheet is applied to an outer face of the back plate so as to cover at least a portion of the aperture.

10. The image forming apparatus according to claim 9, wherein the insulating sheet is applied to the outer face of the back plate so as to cover a portion of the aperture while leaving another portion of the aperture uncovered on the downstream side of the airflow.

11. An image forming apparatus comprising:

a photosensitive body on which a photosensitive layer is provided; and a charger having a discharge electrode, a back plate and an insulator sheet applied to an inner face of the back plate opposed to the photosensitive body for charging a surface of the photosensitive body, wherein an applying rate of the insulator sheet is smaller on a first side of the photosensitive body than on a second side of the photosensitive body.

12. The image forming apparatus according to claim 11, wherein the photosensitive layer is formed by dipping.

13. The image forming apparatus according to claim 12, wherein the first side of the photosensitive body corresponds to an upper portion and the second side of the photosensitive body corresponds to a lower portion when the dipping is performed to the photosensitive body.

14. An image forming apparatus comprising:

a photosensitive body on which a photosensitive layer is provided; and a charger opposed the photosensitive body for charging a surface of the photosensitive body, wherein an interval between the surface of the photosensitive body and the charger is narrower on a first side of the photosensitive body than on a second side thereof, and the charger is provided with a roller with a taper so as to have a large diameter on a side corresponding to the first side of the photosensitive body and a small diameter on a side corresponding to the second side of the photosensitive body.

15. The image forming apparatus according to claim 14, wherein the taper of the roller is provided by forming a surface layer thereof by dipping.

16. An image forming apparatus comprising:

a photosensitive body on which a photosensitive layer is provided; and a charger opposed the photosensitive body for charging a surface of the photosensitive body, wherein an interval between the surface of the photosensitive body and the charger is narrower on a first side of the photosensitive body than on a second side thereof, and wherein the photosensitive layer is formed by dipping.

17. The image forming apparatus according to claim 16, wherein the first side of the photosensitive body corresponds to an upper portion and the second side of the photosensitive body corresponds to a lower portion when the dipping is performed to the photosensitive body.

18. An image forming apparatus comprising:

a photosensitive body on which a photosensitive layer is provided; and a charger opposed the photosensitive body for charging a surface of the photosensitive body, wherein an interval between the surface of the photosensitive body and the charger is narrower on a first side of the photosensitive body than on a second side thereof, and wherein the charger is provided with a pair of spacers on both sides thereof for rectifying the interval between the surface of the photosensitive body and the charger by being brought into contact with the surface of the photosensitive body.

19. The image forming apparatus according to claim 18, wherein the pair of spacers are provided with different colors.

20. An image forming apparatus comprising:

a photosensitive body on which a photosensitive layer is provided; and a charger opposed the photosensitive body for charging a surface of the photosensitive body, wherein an interval is formed between the surface of photosensitive body and the charger such that an interval difference between a first side and a second side of the photosensitive body is set to a predetermined value, wherein the predetermined value is set in accordance with a thickness of the photosensitive layer.

21. The image forming apparatus according to claim 20, wherein the charger is a scorotron charger having a discharge electrode and a grid, and an interval between the grid and the surface of the photosensitive body is narrower on the first side of the photosensitive body than on the second side thereof.

22. The image forming apparatus according to claim 21, wherein the interval between the grid and the surface of the photosensitive body is narrower on the first side of the photosensitive body than on the second side thereof by changing heights of grid supporting portions for supporting both sides of the grid.

23. The image forming apparatus according to claim 20, wherein the charger is provided with a roller with a taper so as to have a large diameter on a side corresponding to the first side of the photosensitive body and a small diameter on a side corresponding to the second side of the photosensitive body.

24. The image forming apparatus according to claim 23, wherein the taper of the roller is provided by forming a surface layer thereof by dipping.

25. The image forming apparatus according to claim 20, wherein the photosensitive layer is formed by dipping.

26. The image forming apparatus according to claim 25, wherein the first side of the photosensitive body corresponds to an upper portion and the second side of the photosensitive body corresponds to a lower portion when the dipping is performed to the photosensitive body.

27. The image forming apparatus according to claim 20, wherein the charger is provided with a pair of spacers on both sides thereof for rectifying the interval between the surface of the photosensitive body and the charger by being brought into contact with the surface of the photosensitive body.

28. The image forming apparatus according to claim 27, wherein the pair of spacers are provided with different colors.

29. An image forming apparatus comprising:

a photosensitive body on which a photosensitive layer is provided; and a charger opposed the photosensitive body for charging a surface of the photosensitive body, wherein an interval is formed between the surface of photosensitive body and the charger such that an interval difference between a first side and a second side of the photosensitive body is set to a predetermined value, wherein the charger has a discharge electrode, and an interval between the discharge electrode and the surface of the photosensitive body is narrower on the first side of the photosensitive body than on the second side thereof by changing heights of discharge electrode supporting portions for supporting both sides of the discharge electrode.

* * * * *